US011719241B2

(12) United States Patent
Chiba et al.

(10) Patent No.: US 11,719,241 B2
(45) Date of Patent: Aug. 8, 2023

(54) SCREW COMPRESSOR HAVING A LUBRICATION PATH FOR A PLURALITY OF SUCTION SIDE BEARINGS

(71) Applicant: Hitachi Industrial Equipment Systems Co., Ltd., Tokyo (JP)

(72) Inventors: Kotaro Chiba, Tokyo (JP); Masahiko Takano, Tokyo (JP); Shigeyuki Yorikane, Tokyo (JP); Kenji Morita, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 17/288,374

(22) PCT Filed: Sep. 4, 2019

(86) PCT No.: PCT/JP2019/034776
§ 371 (c)(1),
(2) Date: Apr. 23, 2021

(87) PCT Pub. No.: WO2020/084916
PCT Pub. Date: Apr. 30, 2020

(65) Prior Publication Data

US 2021/0381510 A1 Dec. 9, 2021

(30) Foreign Application Priority Data

Oct. 26, 2018 (JP) ..... 2018-201814

(51) Int. Cl.
*F04C 18/16* (2006.01)
*F04C 29/02* (2006.01)
*F04C 29/00* (2006.01)

(52) U.S. Cl.
CPC ..... *F04C 18/16* (2013.01); *F04C 29/0007* (2013.01); *F04C 29/02* (2013.01);
(Continued)

(58) Field of Classification Search
CPC ..... F04C 18/08–088; F04C 18/14–20; F04C 2/08–088; F04C 2/14–20;
(Continued)

(56) References Cited

U.S. PATENT DOCUMENTS 4,662,832 A * 5/1987 Dammann ..... F04C 18/084 418/201.3
5,037,282 A * 8/1991 Englund ..... F04C 29/0028 418/98
(Continued)

FOREIGN PATENT DOCUMENTS

JP 59215985 A * 5/1983
JP 59-215985 A 12/1984
(Continued)

OTHER PUBLICATIONS

International Preliminary Report on Patentability (PCT/IB/338 & PCT/IB/373) issued in PCT Application No. PCT/JP2019/034776 dated May 6, 2021, Including English translation of document C2 (Japanese-language Written Opinion (PCT/ISA/237), filed on Apr. 23, 2021) (eight (8) pages).
(Continued)

*Primary Examiner* — Laert Dounis
(74) *Attorney, Agent, or Firm* — Crowell & Moring LLP

(57) ABSTRACT

A screw compressor includes plural screw rotors, plural suction-side bearings that each rotatably support the suction side of the plural screw rotors and plural discharge-side bearings that each rotatably support the discharge side of the plural screw rotors, and a casing that houses the plural screw rotors, the plural suction-side bearings, and the plural discharge-side bearings. Each screw rotor includes a lobe section with plural lobes and a suction-side shaft section and a discharge-side shaft section each disposed at both ends of the lobe section. The casing has a housing chamber that houses the lobe sections of the plural screw rotors and a
(Continued)

lubrication path in which liquid that lubricates the plural suction-side bearings circulates. In the lubrication path, respective passages to lubricate each of the plural suction-side bearings are connected in series and a most downstream part is connected to the housing chamber.

7 Claims, 9 Drawing Sheets

(52) U.S. Cl.
CPC ..... *F04C 29/026* (2013.01); *F04C 2240/30* (2013.01); *F04C 2240/52* (2013.01)

(58) Field of Classification Search
CPC ..... F04C 15/0088; F04C 15/0092; F04C 29/0007; F04C 29/02–028; F04C 2240/50–56; F01C 1/08–088; F01C 1/14–20; F01C 21/001; F01C 21/04; F01C 21/045; F01C 21/02
USPC ..... 418/98

See application file for complete search history.

(56) References Cited

U.S. PATENT DOCUMENTS

| | | | | |
|---|---|---|---|---|
| 2017/0356448 | A1* | 12/2017 | Akei | F04C 18/16 |
| 2018/0023571 | A1 | 1/2018 | Endo | |

FOREIGN PATENT DOCUMENTS

| | | | |
|---|---|---|---|
| JP | 7-4370 | A | 1/1995 |
| JP | 2846065 | B2 | 1/1999 |
| JP | 2002-21758 | A | 1/2002 |
| JP | 2014-194186 | A | 10/2014 |
| JP | 2014-214740 | A | 11/2014 |
| WO | WO-8303641 | A1 * | 3/1983 |
| WO | WO 2016/129083 | A1 | 8/2016 |

OTHER PUBLICATIONS

International Search Report (PCT/ISA/210) issued in PCT Application No. PCT/JP2019/034776 dated Nov. 26, 2019 with English translation (five (5) pages).
Japanese-language Written Opinion (PCT/ISA/237) issued in PCT Application No. PCT/JP2019/034776 dated Nov. 26, 2019 (four (4) pages).

* cited by examiner

SCREW COMPRESSOR HAVING A LUBRICATION PATH FOR A PLURALITY OF SUCTION SIDE BEARINGS

TECHNICAL FIELD

The present invention relates to a screw compressor and more specifically relates to a screw compressor that lubricates bearings by liquid feed.

BACKGROUND ART

The screw compressor includes screw rotors that mesh with each other, bearings that rotatably support the screw rotors, and a casing that houses the screw rotors and the bearings. The screw rotor has a lobe section with plural helical lobes and shaft sections each disposed at both ends of the lobe section. The screw compressor compresses gas through increase and decrease in the volumes of working chambers formed by lobe grooves of the screw rotors and the inner wall surface of the casing in association with rotation of the screw rotors. The bearings are lubricated by liquid fed from the external of the compressor.

Among the screw compressors, there is a screw compressor that collects the liquid to lubricate the bearings that support the suction side of the screw rotors into the internal space of the casing that houses the lobe sections of the screw rotors. As such a screw compressor including a liquid feed system for the suction-side bearings, there is one described in Patent Document 1, for example. In an oil-cooling type screw compressor described in patent document 1, in order to reduce stirring loss of lubricating oil at bearings, a first collection hole is formed in a partition between spaces that house suction-side bearings that support suction-side end portions of a pair of screw rotors and a space that houses lobe sections of the pair of screw rotors. In addition, a second collection hole that bypasses the first collection hole is formed in the partition. In this oil-cooling type screw compressor, the lubricating oil after lubrication of the suction-side bearings is made to flow to the screw rotor side through the first collection hole and is collected, whereas part of the lubricating oil fed to the suction-side bearings is introduced directly to the lobe section side of the screw rotors through the second collection hole without lubricating the suction-side bearings and is collected.

PRIOR ART DOCUMENT

Patent Document

Patent Document 1: JP-2002-21758-A

SUMMARY OF THE INVENTION

Problem to be Solved by the Invention

In the oil-cooling type screw compressor described in patent document 1, the whole quantity of lubricating oil fed to the suction-side bearing that supports one (male screw rotor) of the pair of screw rotors is finally collected into the space that houses the lobe sections of the screw rotors (hereinafter, referred to as housing space) through the first collection hole and the second collection hole. The flow rate of the lubricating oil collected into the housing space does not change even in a configuration without the second collection hole. That is, the second collection hole may reduce the flow rate of the lubricating oil that passes through the suction-side bearing, but cannot reduce the flow rate of the lubricating oil collected into the housing space.

Furthermore, in the oil-cooling type screw compressor described in patent document 1, feed and collection of the lubricating oil are executed by different two paths for the suction-side bearings that each support the pair of (male and female) screw rotors. That is, the oil-cooling type screw compressor has a configuration in which the respective paths to lubricate the respective suction-side bearings are in parallel. Specifically, the lubricating oil fed to one suction-side bearing is collected into the housing space through the first collection hole and the second collection hole. The lubricating oil fed to the other suction-side bearing is collected into the housing space through a third collection hole. Therefore, the flow rate of the lubricating oil collected into the housing space is the sum of the flow rate of the lubricating oil for the one suction-side bearing and the flow rate of the lubricating oil for the other suction-side bearing.

The lubricating oil collected into the housing space of the casing causes an increase in the power of the screw rotors that stir the oil. Furthermore, scattering of the lubricating oil collected in the housing space to the vicinity of a gas suction port of the casing by rotation of the screw rotors causes heating and pressure loss of the sucked gas. This brings the lowering of the compression efficiency due to decrease in the flow rate of the compressed gas. Therefore, there is a demand to reduce the flow rate of the lubricating oil for the suction-side bearings collected into the housing space of the casing.

In a liquid-flooded type screw compressor in which liquid is fed to the working chambers, there is a demand to reduce the flow rate of the liquid for suction-side bearings collected into the housing space in particular. As the liquid-flooded type screw compressor, in recent years, a screw compressor has been proposed in which liquid atomized through enhancing the liquid feed pressure is fed to the working chambers for the purpose of improving the cooling effect of the compressed gas in the working chambers. In the liquid-flooded type screw compressor, a system to feed the liquid to the working chambers and a system to feed the liquid to the bearings are connected to each other and therefore the amount of liquid fed to the bearings tends to increase in association with the rise of the liquid feed pressure. As a result, the flow rate of the liquid for the suction-side bearings collected into the housing space also tends to increase. Therefore, in the liquid-flooded type screw compressor in which the liquid feed pressure is enhanced, the above-described problem is of concern.

The present invention is made in order to solve the above-described problem and an object of the present invention is to provide a screw compressor that can reduce the flow rate of liquid for suction-side bearings collected into the internal space of a casing.

Means for Solving the Problem

The present application includes plural means to solve the above-described problem. To cite one example thereof, a screw compressor includes a plurality of screw rotors, a plurality of suction-side bearings that each rotatably support a suction side of the plurality of screw rotors and a plurality of discharge-side bearings that each rotatably support a discharge side of the plurality of screw rotors, and a casing that houses the plurality of screw rotors, the plurality of suction-side bearings, and the plurality of discharge-side bearings. Each of the plurality of screw rotors includes a lobe section with a plurality of lobes and a suction-side shaft section and a discharge-side shaft section each disposed at both ends of the lobe section. The casing has a housing chamber that houses the lobe sections of the plurality of screw rotors and a lubrication path in which liquid that lubricates the plurality of suction-side bearings circulates. The lubrication path is a path in which respective passages to lubricate each of the plurality of suction-side bearings are connected in series and a most downstream part is connected to the housing chamber.

Advantages of the Invention

According to the present invention, the respective passages to lubricate each of the plural suction-side bearings are connected in series. Thus, the liquid does not need to be fed to the lubrication path at the flow rate obtained by summing up the necessary feed flow rates of the respective suction-side bearings, and it suffices that the liquid is fed at the highest flow rate in the necessary feed flow rates of the respective suction-side bearings. Therefore, compared with a conventional configuration in which the respective paths to lubricate the plural suction-side bearings are in parallel, the flow rate of the liquid for the suction-side bearings collected into the housing chamber of the casing can be reduced.

Problems, configurations, and effects other than the above-described ones will be made clear by the following description of embodiments.

MODES FOR CARRYING OUT THE INVENTION

Screw compressors according to embodiments of the present invention will be exemplified below by using drawings. The present embodiments are what is obtained by applying the present invention to twin-rotor, liquid-flooded type screw compressors.

First Embodiment

Figure 1:
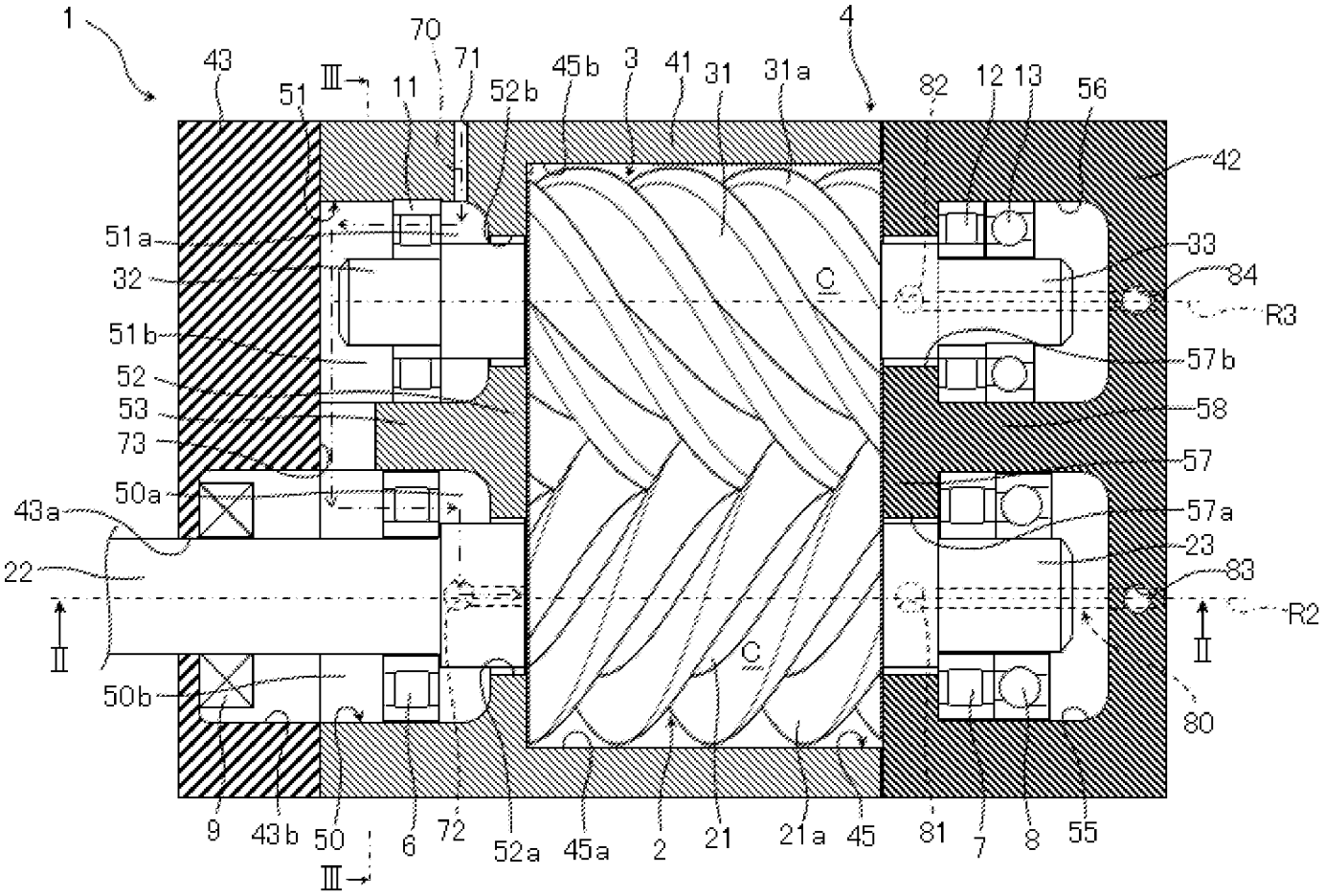
FIG. 1 is a horizontal sectional view illustrating a screw compressor according to a first embodiment of the present invention.
Figure 2:
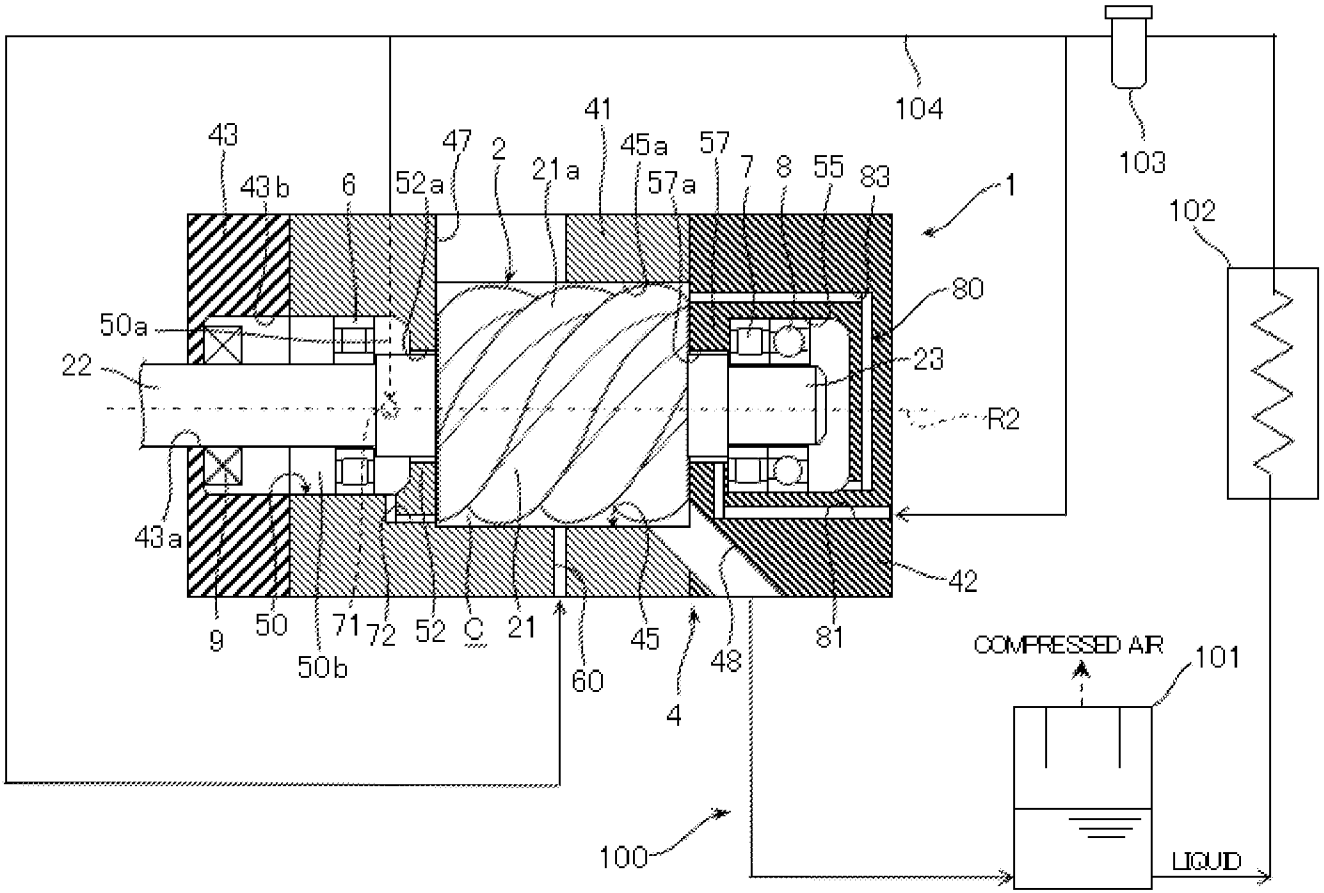
FIG. 2 is a sectional view when the screw compressor according to the first embodiment of the present invention illustrated in FIG. 1 is viewed in a direction of arrows II-II and is a system diagram illustrating an external path of liquid fed to the screw compressor according to the first embodiment of the present invention.
Figure 3:
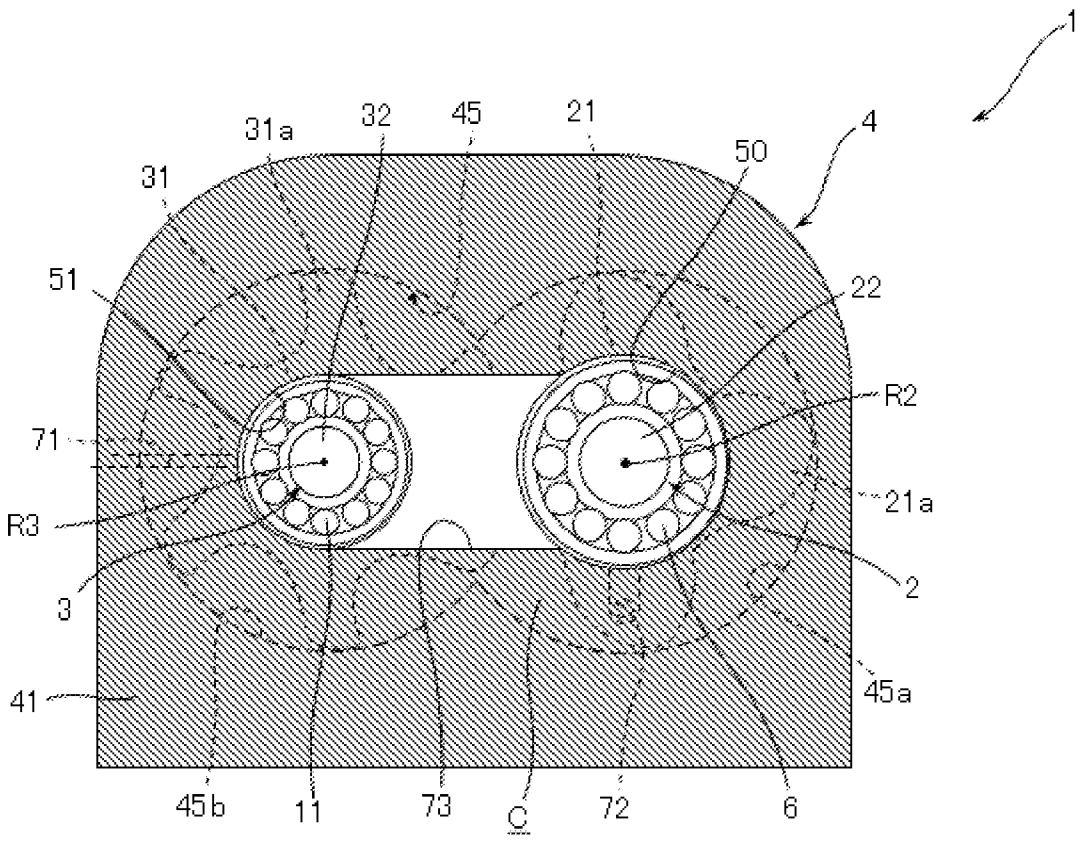
FIG. 3 is a sectional view when the screw compressor according to the first embodiment of the present invention illustrated in FIG. 1 is viewed in a direction of arrows III-III.

The configuration of a screw compressor according to a first embodiment will be described by using FIG. 1 to FIG. 3. FIG. 1 is a horizontal sectional view illustrating the screw compressor according to the first embodiment of the present invention. FIG. 2 is a sectional view when the screw compressor according to the first embodiment of the present invention illustrated in FIG. 1 is viewed in a direction of arrows II-II and is a system diagram illustrating an external path of liquid fed to the screw compressor according to the first embodiment of the present invention. FIG. 3 is a sectional view when the screw compressor according to the first embodiment of the present invention illustrated in FIG. 1 is viewed in a direction of arrows III-III. In FIG. 1 and FIG. 2, the left side is the suction side of the screw compressor and the right side is the discharge side.

In FIG. 1 and FIG. 2, a screw compressor 1 includes a pair of male rotor 2 (male screw rotor) and female rotor 3 (female screw rotor) that mesh with each other and a casing 4 that rotatably houses both the male and female rotors 2 and 3. The suction side and the discharge side of the male rotor 2 are rotatably supported by a first suction-side bearing 6 and first discharge-side bearings 7 and 8, respectively. The male rotor 2 is connected to a rotational drive source (not illustrated) such as a motor, for example. The suction side and the discharge side of the female rotor 3 are rotatably supported by a second suction-side bearing 11 and second discharge-side bearings 12 and 13, respectively. The first suction-side bearing 6, the second suction-side bearing 11, the first discharge-side bearings 7 and 8, and the second discharge-side bearings 12 and 13 are housed in the casing 4. The screw compressor 1 is disposed in such a manner that axis lines R2 and R3 of both of the male rotor 2 and the female rotor 3 are horizontal (see also FIG. 3), for example.

The male rotor 2 includes a lobe section 21 with plural (in FIGS. 1 to 3, four) helical male lobes 21*a* and a suction-side shaft section 22 and a discharge-side shaft section 23 each disposed at both end portions of the lobe section 21 in the axial direction (in FIG. 1 and FIG. 2, left-right direction). The first suction-side bearing 6 and the first discharge-side bearings 7 and 8 are attached to the suction-side shaft section 22 and the discharge-side shaft section 23, respectively, of the male rotor 2. The suction-side shaft section 22 extends to the outside of the casing 4 and has, for example, a configuration monolithic with a shaft section of the rotational drive source (not illustrated), for example.

As illustrated in FIG. 1, the female rotor 3 includes a lobe section 31 with plural (in FIGS. 1 to 3, six) helical female lobes 31*a* and a suction-side shaft section 32 and a discharge-side shaft section 33 each disposed at both end portions of the lobe section 31 in the axial direction (in FIG. 1, left-right direction). The number of female lobes 31*a* of the female rotor 3 is set to be larger than the number of male lobes 21*a* of the male rotor 2. The outer diameter of the suction-side shaft section 32 and the discharge-side shaft section 33 of the female rotor 3 is set to be smaller than the outer diameter of the suction-side shaft section 22 and the discharge-side shaft section 23 of the male rotor 2 (see also FIG. 3), for example. This is because the rotation speed of the female rotor 3 is lower than that of the male rotor 2 due to the difference in the number of lobes and the compression torque of the female rotor 3 becomes lower than that of the male rotor 2 due to difference in the shape between the female lobes 31*a* and the male lobes 21*a* and consequently a load received by the suction-side shaft section 32 and the discharge-side shaft section 33 of the female rotor 3 shows a tendency of becoming smaller than a load received by the suction-side shaft section 22 and the discharge-side shaft section 23 of the male rotor 2.

The second suction-side bearing 11 and the second discharge-side bearings 12 and 13 are attached to the suction-side shaft section 32 and the discharge-side shaft section 33, respectively, of the female rotor 3. The outer diameter of the second suction-side bearing 11 and the second discharge-side bearings 12 and 13 is set to be smaller than the outer diameter of the first suction-side bearing 6 and the first discharge-side bearings 7 and 8 according to the outer diameter of the suction-side shaft section 32 and the discharge-side shaft section 33 of the female rotor 3.

As illustrated in FIG. 1 and FIG. 2, the casing 4 includes a main casing 41 and a discharge-side casing 42 attached to the discharge side of the main casing 41. Inside the casing 4, a bore 45 is formed as a housing chamber in which the lobe section 21 of the male rotor 2 and the lobe section 31 of the female rotor 3 are housed in the state of meshing with each other. The bore 45 is configured by closing, by the discharge-side casing 42, an opening, on one side (in FIG. 1 and FIG. 2, right side) in the axial direction, of two partly overlapped cylindrical spaces that are formed in the main casing 41. The bore 45 is composed of a male-side bore 45*a* as a first housing section in which most part of the lobe section 21 of the male rotor 2 is disposed and a female-side bore 45*b* as a second housing section in which most part of the lobe section 31 of the female rotor 3 is disposed (see also FIG. 3).

A gap of several tens to several hundreds of micrometers is set between the inner wall surface of the casing 4 (wall surface that defines the bore 45) and the lobe sections 21 and 31 of both the male and female rotors 2 and 3. Plural working chambers C are formed by plural lobe grooves of the lobe sections 21 and 31 of both the male and female rotors 2 and 3 and the inner wall surface of the casing 4 (wall surface of the bore 45) that surrounds them.

As illustrated in FIG. 2, the casing 4 has a suction flow passage 47 for sucking a gas into the working chambers C. The suction flow passage 47 communicates the bore 45 (working chambers C) with the external of the casing 4 and is formed in the main casing 41, for example. The casing 4 has a discharge flow passage 48 for discharging a compressed gas from the working chambers C to the external of the casing 4. The discharge flow passage 48 communicates the bore 45 (working chambers C) with the external of the casing 4 and is formed across the main casing 41 and the discharge-side casing 42, for example.

As illustrated in FIG. 1 and FIG. 2, there are provided at a suction-side end portion of the main casing 41 in the axial direction a first suction-side bearing chamber 50 in which the first suction-side bearing 6 is disposed and a second suction-side bearing chamber 51 in which the second suction-side bearing 11 is disposed. In the first and second suction-side bearing chambers 50 and 51, one side in the axial direction (in FIG. 1 and FIG. 2, left side) is opened whereas the other side in the axial direction (in FIG. 1 and FIG. 2, right side) is separated from the bore 45 by a suction-side partition 52. The first suction-side bearing chamber 50 and the second suction-side bearing chamber 51 are marked out by a bearing chamber partition 53. The first suction-side bearing chamber 50 is divided into a primary chamber 50*a* close to the bore 45 and a secondary chamber 50*b* remoter from the bore 45 than the primary chamber 50*a* across the first suction-side bearing 6. The second suction-side bearing chamber 51 is divided into a primary chamber 51*a* close to the bore 45 and a secondary chamber 51*b* remoter from the bore 45 than the primary chamber 51*a* across the second suction-side bearing 11.

There are provided in the suction-side partition 52 a first suction-side shaft hole 52*a* in which the suction-side shaft section 22 of the male rotor 2 is inserted and a second suction-side shaft hole 52*b* in which the suction-side shaft section 32 of the female rotor 3 is inserted. In the first and second suction-side shaft holes 52*a* and 52*b*, the suction-side shaft section 22 of the male rotor 2 and the suction-side shaft section 32 of the female rotor 3 are respectively disposed with a gap of several tens to several hundreds of micrometers.

A suction-side cover 43 is attached to the main casing 41 and closes the openings of the first and second suction-side bearing chambers 50 and 51. There is provided in the suction-side cover 43 a cover shaft hole 43*a* in which the suction-side shaft section 22 of the male rotor 2 is inserted. the suction-side shaft section 22 of the male rotor 2 is disposed in the cover shaft hole 43*a* with a gap of several tens to several hundreds of micrometers.

The gap between the cover shaft hole 43*a* and the suction-side shaft section 22 is sealed by a seal member 9. The seal member 9 is an oil seal or mechanical seal, for example. A seal chamber 43*b* in which the seal member 9 is disposed is provided in the suction-side cover 43. The seal chamber 43*b* forms one space together with the secondary chamber 50*b* of the first suction-side bearing chamber 50.

There are provided in the discharge-side casing 42 a first discharge-side bearing chamber 55 in which the first discharge-side bearings 7 and 8 are disposed and a second discharge-side bearing chamber 56 in which the second discharge-side bearings 12 and 13 are disposed. The first and second discharge-side bearing chambers 55 and 56 are separated from the bore 45 by a discharge-side partition 57. The first discharge-side bearing chamber 55 and the second discharge-side bearing chamber 56 are marked out by a bearing chamber partition 58.

There are provided in the discharge-side partition 57 a first discharge-side shaft hole 57*a* in which the discharge-side shaft section 23 of the male rotor 2 is inserted and a second discharge-side shaft hole 57*b* in which the discharge-side shaft section 33 of the female rotor 3 is inserted. In the first and second discharge-side shaft holes 57*a* and 57*b*, the discharge-side shaft section 23 of the male rotor 2 and the discharge-side shaft section 33 of the female rotor 3, respectively, are disposed with a gap of several tens to several hundreds of micrometers.

The screw compressor 1 is a liquid-flooded type in which liquid (for example, oil or water) is injected into the working chambers C. Purposes of injecting the liquid into the working chambers C are lubrication of the male rotor 2 and the female rotor 3, cooling of a gas in the working chambers C, sealing of the gap between both the male and female rotors 2 and 3 and the inner wall surface of the casing 4 (wall surface of the bore 45) and the gap between the meshing portions of the male rotor 2 and the female rotor 3, and so forth. Thus, as illustrated in FIG. 2, an external liquid feed system 100 that feeds the liquid is connected to the screw compressor 1. The external liquid feed system 100 includes a gas-liquid separator 101, a liquid cooler 102, auxiliary machinery 103 such as filter and check valve, and a conduit line 104 that connects them. The liquid fed from the external liquid feed system 100 is used as the liquid for lubrication also for the first suction-side bearing 6, the second suction-side bearing 11, the first discharge-side bearings 7 and 8, and the second discharge-side bearings 12 and 13 besides the working chambers C. The external liquid feed system 100 has a configuration in which a liquid feed path to the working chambers C and a liquid feed path to the bearings 6, 7, 8, 11, 12, and 13 are branched, for example.

The gas-liquid separator 101 separates the liquid contained in a compressed gas from the compressed gas discharged from the screw compressor 1 and stores therein the separated liquid. The gas-liquid separator 101 is a liquid feed source for the working chambers C, the first suction-side bearing 6, the second suction-side bearing 11, the first discharge-side bearings 7 and 8, and the second discharge-side bearings 12 and 13 of the screw compressor 1.

The screw compressor 1 has an internal liquid feed path for feeding the liquid to the working chambers C inside the casing 4. The internal liquid feed path is configured by a first liquid feed passage 60 provided in the main casing 41. The first liquid feed passage 60 introduces the liquid fed from the external of the screw compressor 1 (external liquid feed system 100) to the working chambers C and is opened to a region in which the working chamber C is in the compression process in the bore 45, for example.

As illustrated in FIG. 1 and FIG. 2, the screw compressor 1 has, inside the casing 4, a first lubrication path 70 in which the liquid that lubricates the first suction-side bearing 6 and the second suction-side bearing 11 circulates. In the first lubrication path 70, a passage to lubricate the first suction-side bearing 6 and a passage to lubricate the second suction-side bearing 11 are connected in series and the most downstream part is connected to the bore 45. For example, the first lubrication path 70 is configured in such a manner that the liquid fed from the external of the screw compressor 1 (external liquid feed system 100) lubricates the second suction-side bearing 11 and the first suction-side bearing 6 in that order and is collected into the bore 45.

Specifically, there is provided in the main casing 41 a second liquid feed passage 71 into which the liquid fed from the external liquid feed system 100 flows. For example, the second liquid feed passage 71 is opened to the outer circumferential surface of the main casing 41 and the primary chamber 51*a* of the second suction-side bearing chamber 51 and allows the primary chamber 51*a* of the second suction-side bearing chamber 51 to communicate with the external of the main casing 41. Furthermore, there is provided in the main casing 41 a first collection liquid passage 72 that collects the liquid that has lubricated the first suction-side bearing 6 and the second suction-side bearing 11 into the bore 45. For example, the first collection liquid passage 72 is opened to the region in the suction process in the bore 45 and the primary chamber 50*a* of the first suction-side bearing chamber 50 and allows the primary chamber 50*a* of the first suction-side bearing chamber 50 to communicate with the region in the suction process in the bore 45. As illustrated in FIG. 1 and FIG. 3, there is provided in the bearing chamber partition 53 of the main casing 41 a communication passage 73 that allows the secondary chamber 51*b* of the second suction-side bearing chamber 51 and the secondary chamber 50*b* of the first suction-side bearing chamber 50 to communicate with each other. That is, the secondary chamber 51*b* of the second suction-side bearing chamber 51 and the secondary chamber 50*b* of the first suction-side bearing chamber 50 are connected with each other through the communication passage 73. The flow passage sectional area of the second liquid feed passage 71 and the first collection liquid passage 72 is set corresponding to the higher flow rate of either one of the necessary feed flow rate of the first suction-side bearing 6 and the necessary feed flow rate of the second suction-side bearing 11.

Based on the above-described configuration, in the first lubrication path 70 of the present embodiment, the second liquid feed passage 71, a passage in which the liquid circulates from the primary chamber 51*a* to the secondary chamber 51*b* of the second suction-side bearing chamber 51 and lubricates the second suction-side bearing 11 (passage that passes from the end surface of the second suction-side bearing 11 on the side of the bore 45 through the end surface on the other side), the communication passage 73, a passage in which the liquid circulates from the seal chamber 43*b* of the suction-side cover 43 and the secondary chamber 50*b* to the primary chamber 50*a* of the first suction-side bearing chamber 50 and lubricates the first suction-side bearing 6 (passage that passes from the end surface of the first suction-side bearing 6 on the opposite side to the side of the bore 45 through the end surface on the side of the bore 45), and the first collection liquid passage 72 are connected in series in that order. The liquid needs to be fed to the first lubrication path 70 at the higher flow rate of either one of the necessary feed flow rate of the first suction-side bearing 6 and the necessary feed flow rate of the second suction-side bearing 11, and the liquid is collected into the bore 45 at the higher flow rate of either one of the necessary feed flow rates of the first and second suction-side bearings 6 and 11.

Furthermore, the screw compressor 1 has, inside the casing 4, a second lubrication path 80 for feeding and collecting the liquid that lubricates the first discharge-side bearings 7 and 8 and the second discharge-side bearings 12 and 13. The second lubrication path 80 is configured in such a manner that the liquid fed from the external of the screw compressor 1 (external liquid feed system 100) lubricates the first discharge-side bearings 7 and 8 and the second discharge-side bearings 12 and 13 and is collected into the bore 45. In the second lubrication path 80, a passage to lubricate the first discharge-side bearings 7 and 8 and a passage to lubricate the second discharge-side bearings 12 and 13 are configured in parallel.

Specifically, there are provided in the discharge-side casing 42 a third liquid feed passage 81 for introducing the liquid from the external liquid feed system 100 to the first discharge-side bearings 7 and 8 and a fourth liquid feed passage 82 for introducing the liquid to the second discharge-side bearings 12 and 13. The third liquid feed passage 81 and the fourth liquid feed passage 82 are different two paths. The third liquid feed passage 81 allows the first discharge-side shaft hole 57*a* to communicate with the external of the discharge-side casing 42, for example. The fourth liquid feed passage 82 allows the second discharge-side shaft hole 57*b* to communicate with the external of the discharge-side casing 42, for example.

Furthermore, there are provided in the discharge-side casing 42 a second collection liquid passage 83 that collects the liquid that has lubricated the first discharge-side bearings 7 and 8 into the bore 45 and a third collection liquid passage 84 that collects the liquid that has lubricated the second discharge-side bearings 12 and 13 into the bore 45. The second collection liquid passage 83 and the third collection liquid passage 84 are different two passages. The second collection liquid passage 83 allows the first discharge-side bearing chamber 55 of the discharge-side casing 42 to communicate with the region in the suction process in the bore 45, for example. The third collection liquid passage 84 allows the second discharge-side bearing chamber 56 of the discharge-side casing 42 to communicate with the region in the suction process in the bore 45, for example. The flow passage sectional area of the third liquid feed passage 81 and the second collection liquid passage 83 is set corresponding to the necessary feed flow rate of the first discharge-side bearings 7 and 8. The flow passage sectional area of the fourth liquid feed passage 82 and the third collection liquid passage 84 is set corresponding to the necessary feed flow rate of the second discharge-side bearings 12 and 13.

On the basis of the above-described configuration, the second lubrication path 80 of the present embodiment is configured by the male-side path in which the third liquid feed passage 81, the first discharge-side shaft hole 57*a*, the first discharge-side bearing chamber 55, and the second collection liquid passage 83 are connected in series in that order and the female-side path in which the fourth liquid feed passage 82, the second discharge-side shaft hole 57*b*, the second discharge-side bearing chamber 56, and the third collection liquid passage 84 are connected in series in that order. In other words, in the second lubrication path 80, the male-side path in which the liquid fed from the external lubricates the first discharge-side bearings 7 and 8 and is collected into the bore 45 and the female-side path in which the liquid fed from the external lubricates the second discharge-side bearings 12 and 13 and is collected into the bore 45 are in parallel. The liquid needs to fed to the second lubrication path 80 at the flow rate obtained by summing up the necessary feed flow rate of the first discharge-side bearings 7 and 8 and the necessary feed flow rate of the second discharge-side bearings 12 and 13, and the liquid is collected into the bore 45 at the flow rate obtained by summing up the necessary feed flow rate of the first discharge-side bearings 7 and 8 and the necessary feed flow rate of the second discharge-side bearings 12 and 13.

Next, the operation of the screw compressor according to the first embodiment will be described by using FIGS. 1 to 3.

When the male rotor 2 illustrated in FIG. 1 is driven by the rotational drive source (not illustrated) such as a motor and rotationally drives the female rotor 3, the working chambers C expand and contract while moving to the discharge side in the axial direction in association with the rotation of both the male and female rotors 2 and 3. Thereby, a gas is sucked into the working chambers C through the suction flow passage 47 illustrated in FIG. 2 and is compressed until reaching a predetermined pressure and thereafter is discharged to the gas-liquid separator 101 through the discharge flow passage 48. The gas-liquid separator 101 separates the compressed gas and the liquid contained in the compressed gas. The compressed gas from which the liquid has been removed is supplied to external equipment (not illustrated) whereas the liquid separated from the compressed gas is stored in the gas-liquid separator 101.

The liquid in the gas-liquid separator 101 is cooled by the liquid cooler 102 of the external liquid feed system 100 and thereafter is fed to the screw compressor 1 through the auxiliary machinery 103. In the external liquid feed system 100, it is possible to feed the liquid to the screw compressor 1 by using the pressure of the compressed gas that flows into the gas-liquid separator 101 as the drive source without using a source of power such as a pump.

Part of the liquid fed from the external liquid feed system 100 to the screw compressor 1 is injected into the working chambers C in the compression process through the first liquid feed passage 60. By the injected liquid, the male rotor 2 and the female rotor 3 illustrated in FIG. 1 are lubricated. Furthermore, the compressed gas in the working chambers C is cooled. Moreover, the gap between both the male and female rotors 2 and 3 and the inner wall surface of the casing 4 (wall surface of the bore 45), the gap between the meshing portions of the male rotor 2 and the female rotor 3, and so forth are sealed. The liquid injected into the working chambers C is discharged into the gas-liquid separator 101 through the discharge flow passage 48 together with the compressed gas as illustrated in FIG. 2.

Furthermore, part of the liquid fed from the external liquid feed system 100 lubricates the first discharge-side bearings 7 and 8 and the second discharge-side bearings 12 and 13 through the second lubrication path 80. Specifically, the part of the liquid from the external liquid feed system 100 flows into the gap between the first discharge-side shaft hole 57*a* and the discharge-side shaft section 23 of the male rotor 2 through the third liquid feed passage 81 of the discharge-side casing 42 illustrated in FIG. 1 and FIG. 2. The liquid that has flown into this gap lubricates the first discharge-side bearings 7 and 8 while passing through them and flows out into the space of the first discharge-side bearing chamber 55. The liquid in the first discharge-side bearing chamber 55 is collected into the region of the suction process of the working chambers C in the bore 45 through the second collection liquid passage 83.

In addition, part of the liquid from the external liquid feed system 100 flows into the gap between the second discharge-side shaft hole 57*b* and the discharge-side shaft section 33 of the female rotor 3 through the fourth liquid feed passage 82 of the discharge-side casing 42 illustrated in FIG. 1. The liquid that has flown into this gap lubricates the second discharge-side bearings 12 and 13 while passing through them and flows out into the space of the second discharge-side bearing chamber 56. The liquid in the second discharge-side bearing chamber 56 is collected into the region of the suction process of the working chambers C in the bore 45 through the third collection liquid passage 84.

As above, in the second lubrication path 80, the first discharge-side bearings 7 and 8 and the second discharge-side bearings 12 and 13 are lubricated by different paths. In addition, the liquid that has lubricated the first discharge-side bearings 7 and 8 and the second discharge-side bearings 12 and 13 is collected into the bore 45 through different paths. The liquid collected into the bore 45 is discharged to the external of the casing 4 through the discharge flow passage 48 together with the compressed gas.

Moreover, part of the liquid fed from the external liquid feed system 100 lubricates the first suction-side bearing 6 and the second suction-side bearing 11 through the first lubrication path 70 illustrated in FIG. 1. Specifically, the part of the liquid from the external liquid feed system 100 flows into the primary chamber 51*a* of the second suction-side bearing chamber 51 through the second liquid feed passage 71 of the main casing 41. The liquid in the primary chamber 51*a* of the second suction-side bearing chamber 51 lubricates the second suction-side bearing 11 while passing through it and flows out to the secondary chamber 51*b* of the second suction-side bearing chamber 51. The liquid in the secondary chamber 51*b* of the second suction-side bearing chamber 51 flows into the secondary chamber 50*b* of the first suction-side bearing chamber 50 and the seal chamber 43*b* of the suction-side cover 43 through the communication passage 73 and then lubricates the seal member 9. The liquid in the secondary chamber 50*b* of the first suction-side bearing chamber 50 lubricates the first suction-side bearing 6 while passing through it and flows out to the primary chamber 50*a* of the first suction-side bearing chamber 50. The liquid in the primary chamber 50*a* of the first suction-side bearing chamber 50 is collected into the region of the suction process of the working chambers C in the bore 45 through the first collection liquid passage 72. The liquid collected into the bore 45 is discharged to the external of the casing 4 through the discharge flow passage 48 illustrated in FIG. 2 together with the compressed gas. The liquid in the seal chamber 43*b* is prevented from leaking from the gap between the cover shaft hole 43*a* and the suction-side shaft section 22 of the male rotor 2 by the seal member 9.

As above, in the first lubrication path 70 of the present embodiment, the liquid fed from the external liquid feed system 100 lubricates the second suction-side bearing 11 and thereafter lubricates the first suction-side bearing 6 and is finally collected into the bore 45. That is, the first lubrication path 70 is the path obtained by connecting in series, sequentially from the upstream side, the second liquid feed passage 71, the passage to lubricate the second suction-side bearing 11 from the primary chamber 51*a* to the secondary chamber 51*b* of the second suction-side bearing chamber 51, the communication passage 73, the passage to lubricate the first suction-side bearing 6 from the seal chamber 43*b* of the suction-side cover 43 and the secondary chamber 50*b* of the first suction-side bearing chamber 50 to the primary chamber 50*a*, and the first collection liquid passage 72.

In the first lubrication path 70 in which the respective passages to lubricate the first suction-side bearing 6 and the second suction-side bearing 11 are connected in series, seizure and damage due to insufficiency of the lubrication of the first suction-side bearing 6 and the second suction-side bearing 11 can be prevented by setting the higher flow rate in the necessary liquid feed flow rate of the first suction-side bearing 6 and the necessary liquid feed flow rate of the second suction-side bearing 11 as the liquid feed flow rate of the first lubrication path 70. As a result, the flow rate of the liquid collected into the bore 45 also becomes the higher flow rate in the respective necessary liquid feed flow rates of the first and second suction-side bearings 6 and 11.

In contrast, in the case of a conventional configuration in which the respective paths of the liquid that lubricates the first suction-side bearing 6 and the second suction-side bearing 11 are in parallel, the liquid fed from the external branches to the first suction-side bearing 6 and the second suction-side bearing 11 and lubricates them. Therefore, in order to prevent seizure and damage due to insufficiency of the lubrication, the liquid needs to be fed to the first suction-side bearing 6 and the second suction-side bearing 11 at the necessary liquid feed flow rate for each. Thus, the liquid is collected into the bore 45 at the flow rate obtained by summing up the necessary liquid feed flow rate of the first suction-side bearing 6 and the necessary liquid feed flow rate of the second suction-side bearing 11. That is, in the conventional configuration in which the respective paths of the liquid that lubricates the first suction-side bearing 6 and the second suction-side bearing 11 are in parallel, the flow rate of the liquid collected into the bore 45 is higher by the necessary liquid feed flow rate of either one of the first suction-side bearing 6 and the second suction-side bearing 11 compared with the first lubrication path 70 of the present embodiment.

The increase in the liquid collected in the bore 45 leads to an increase in the power of both the male and female rotors 2 and 3 to stir the liquid. Furthermore, scattering of the liquid collected in the bore 45 to the vicinity of the suction flow passage 47 of the casing 4 by rotation of both the male and female rotors 2 and 3 causes heating and pressure loss of the sucked gas. This leads to the lowering of the compression efficiency due to decrease in the flow rate of the compressed gas.

As described above, according to the first embodiment, the respective passages to lubricate each of the first suction-side bearing 6 and the second suction-side bearing 11 are connected in series. Thus, the liquid does not need to be fed to the first lubrication path 70 at the flow rate obtained by summing up the respective necessary liquid feed flow rates of the first suction-side bearing 6 and the second suction-side bearing 11, and it suffices that the liquid is fed at the highest flow rate in the necessary liquid feed flow rates of the first suction-side bearing 6 and the second suction-side bearing 11. Therefore, compared with the conventional configuration in which the respective paths to lubricate the first suction-side bearing 6 and the second suction-side bearing 11 are in parallel, the flow rate of the liquid for the first suction-side bearing 6 and the second suction-side bearing 11 collected into the bore (housing chamber) 45 of the casing 4 can be reduced. As a result, the power to stir the liquid by both the male and female rotors 2 and 3 decreases. In addition, the amount of scattering of the liquid to the vicinity of the suction flow passage 47 decreases. Therefore, the lowering of the compression efficiency is suppressed and energy saving of the screw compressor can be implemented.

Furthermore, in the present embodiment, the male rotor 2 and the female rotor 3 are disposed in such a manner that the axis lines R2 and R3 of both of the male rotor 2 and the female rotor 3 are horizontal. In addition, the outer diameter of the second suction-side bearing 11 is smaller than the outer diameter of the first suction-side bearing 6. Thus, the lowermost end of the second suction-side bearing 11 is at a higher position than the lowermost end of the first suction-side bearing 6. In addition, in the first lubrication path 70, the second suction-side bearing 11 is located on the upstream side relative to the first suction-side bearing 6. Because of such a configuration, the liquid that has passed through the second suction-side bearing 11 on the upstream side flows to the first suction-side bearing 6 on the downstream side by the self-weight of the liquid in addition to the liquid feed pressure and thus does not stay in the second suction-side bearing chamber 51 in which the second suction-side bearing 11 is disposed. Therefore, the power for stirring the liquid in the second suction-side bearing 11 can be suppressed.

First Modification Example of First Embodiment

Figure 4:
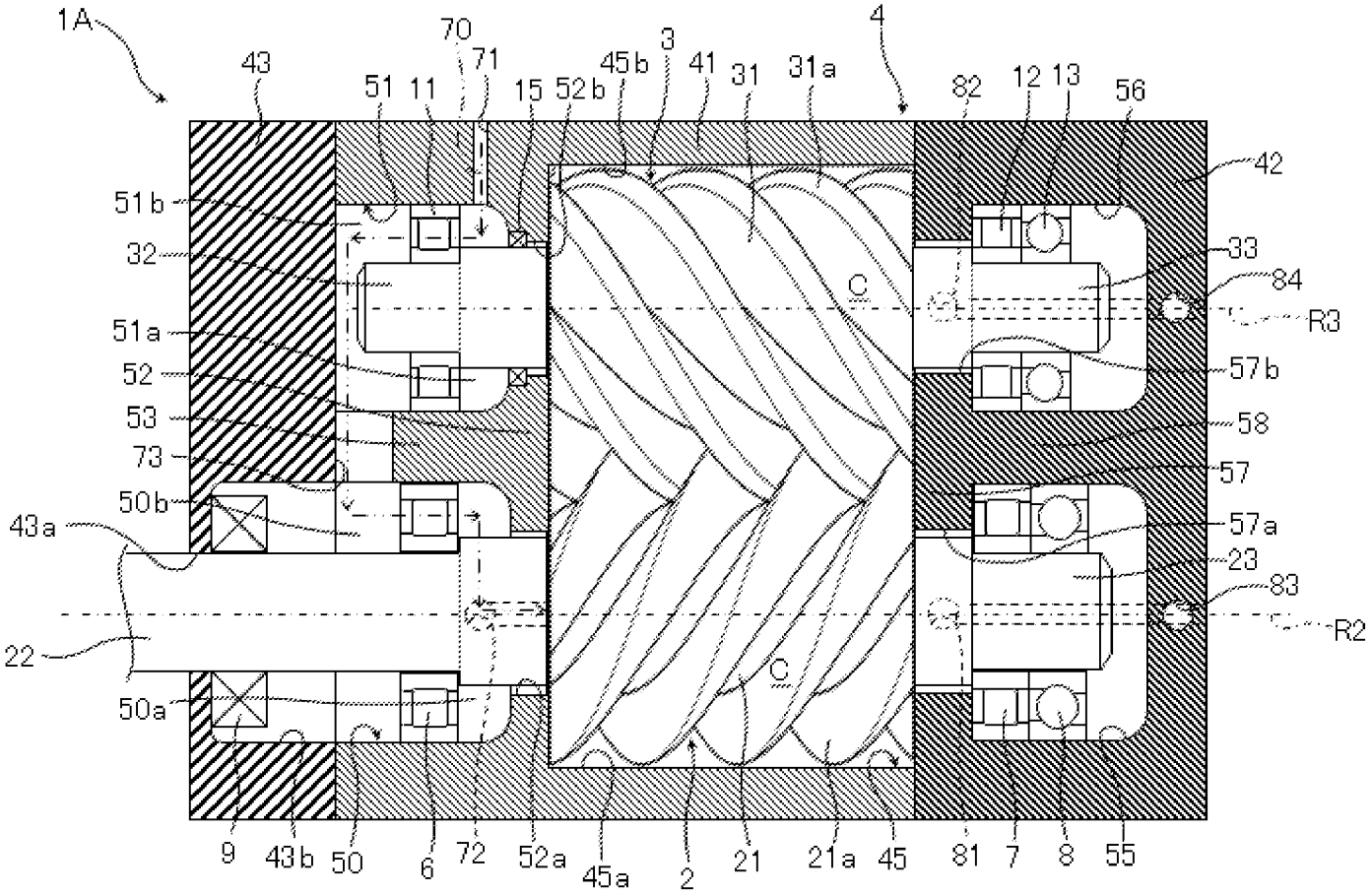
FIG. 4 is a horizontal sectional view illustrating a screw compressor according to a modification example of the first embodiment of the present invention.

Next, a screw compressor according to a first modification example of the first embodiment of the present invention will be exemplified and described by using FIG. 4. FIG. 4 is a horizontal sectional view illustrating the screw compressor according to the modification example of the first embodiment of the present invention. In FIG. 4, the left side is the suction side of the screw compressor and the right side is the discharge side. In FIG. 4, a part having the same numeral as the numeral illustrated in FIG. 1 to FIG. 3 is a similar part and therefore detailed description thereof is omitted.

The different point of a screw compressor 1A according to the first modification example of the first embodiment illustrated in FIG. 4 from the screw compressor 1 (see FIG. 1) according to the first embodiment is that the screw compressor 1A further includes a shaft seal member 15 disposed in the gap between the suction-side shaft section 32 of the female rotor 3 supported by the second suction-side bearing 11 located on the upstream side of the first suction-side bearing 6 in the first lubrication path 70 and the second suction-side shaft hole 52*b* in which the suction-side shaft section 32 is inserted. The shaft seal member 15 seals the gap between the second suction-side shaft hole 52*b* and the suction-side shaft section 32 of the female rotor 3.

In the screw compressor 1 (see FIG. 1) according to the first embodiment, part of the liquid that has flown into the primary chamber 51*a* of the second suction-side bearing chamber 51 through the second liquid feed passage 71 of the main casing 41 leaks from the gap between the second suction-side shaft hole 52*b* and the suction-side shaft section 32 of the female rotor 3 into the bore 45 although only slightly. Thus, the flow rate of the liquid fed from the external liquid feed system 100 to the first lubrication path 70 needs to be increased by the flow rate of the leakage into the bore 45 through the second suction-side shaft hole 52*b*. Part of the liquid that has flown into the primary chamber 50*a* of the first suction-side bearing chamber 50 also leaks from the gap between the first suction-side shaft hole 52*a* and the suction-side shaft section 22 of the male rotor 2 into the bore 45. However, the liquid that has flown into the primary chamber 50*a* of the suction-side bearing chamber 50 has already passed through the first suction-side bearing 6 located on the downstream side in the first lubrication path 70. Therefore, there is no need to increase the flow rate of feed to the first lubrication path 70 in consideration of the leakage into the bore 45 through the first suction-side shaft hole 52*a*. As above, in the first embodiment, the flow rate of the liquid collected into the bore 45 with respect to the first lubrication path 70 increases when the flow rate of the leakage into the bore 45 through the second suction-side shaft hole 52*b* is considered. Thus, the power of both the male and female rotors 2 and 3 to stir the liquid increases. Furthermore, the amount of scattering of the liquid to the vicinity of the suction flow passage 47 increases. Therefore, the amount of heating and pressure loss regarding the sucked gas increase in association with it.

In contrast, according to the first modification example of the first embodiment, since the shaft seal member 15 is disposed in the gap between the suction-side shaft section 32 of the female rotor 3 and the second suction-side shaft hole 52*b*, the liquid that lubricates the second suction-side bearing 11 can be prevented from leaking from the gap between the second suction-side shaft hole 52*b* and the suction-side shaft section 32 of the female rotor 3 into the bore 45. Therefore, it is possible to further reduce the flow rate of the liquid fed to the first lubrication path 70 and the flow rate of the liquid collected into the bore 45 through the first lubrication path 70 compared with the first embodiment. Due to this, the power of both the male and female rotors 2 and 3 to stir the liquid is further suppressed. In addition, the amount of scattering of the liquid to the vicinity of the suction flow passage 47 is further suppressed and the amount of heating and pressure loss regarding the sucked gas are reduced. As a result, energy saving of the screw compressor 1A can be implemented.

Second Embodiment

Figure 5:
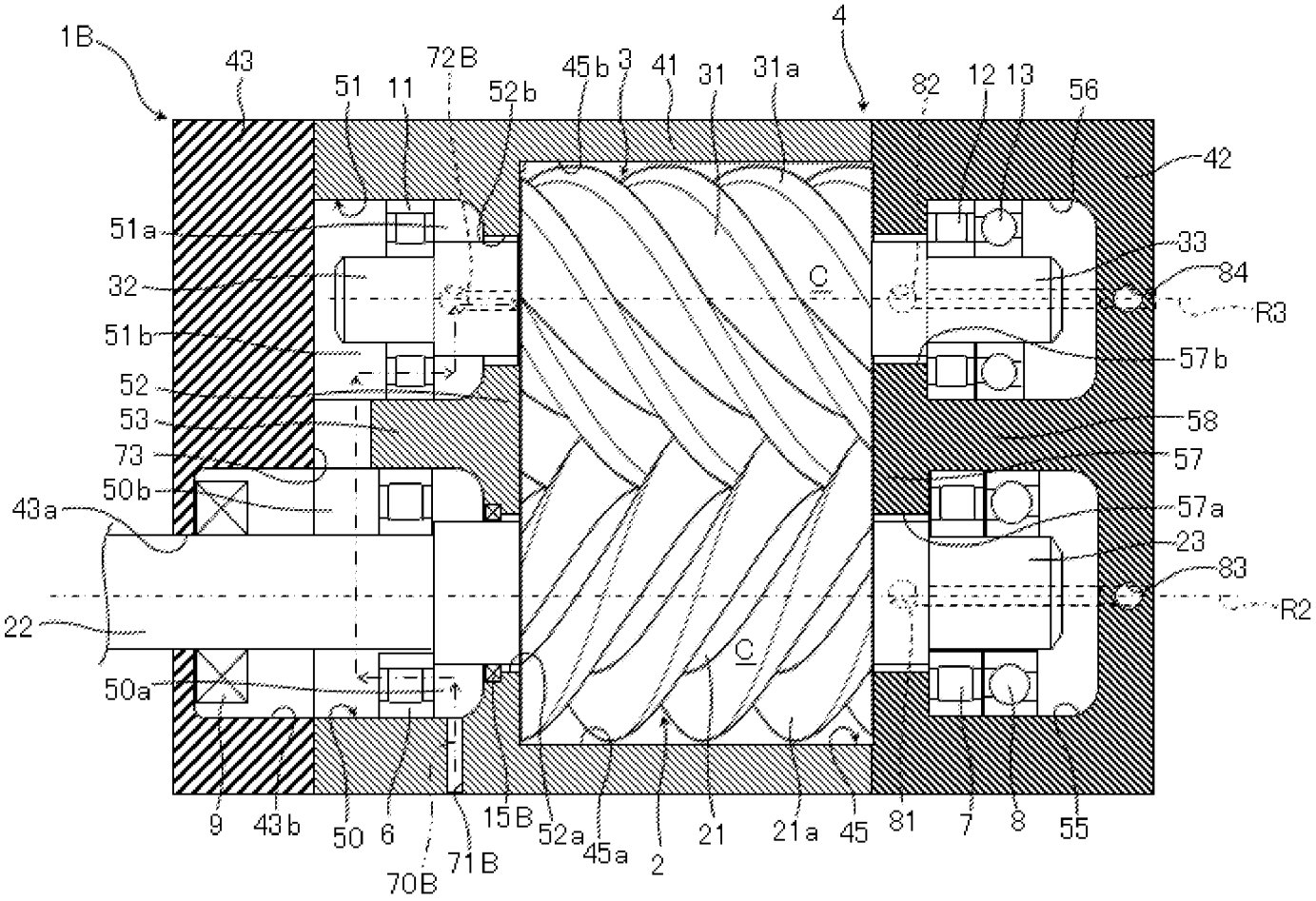
FIG. 5 is a horizontal sectional view illustrating a screw compressor according to a second embodiment of the present invention.

Next, a screw compressor according to a second embodiment of the present invention will be exemplified and described by using FIG. 5. FIG. 5 is a horizontal sectional view illustrating the screw compressor according to the second embodiment of the present invention. In FIG. 5, the left side is the suction side of the screw compressor and the right side is the discharge side. In FIG. 5, a part having the same numeral as the numeral illustrated in FIG. 1 to FIG. 4 is a similar part and therefore detailed description thereof is omitted.

The different point of a screw compressor 1B according to the second embodiment illustrated in FIG. 5 from the screw compressor 1A (see FIG. 4) according to the modification example of the first embodiment is that the order of lubricating the first suction-side bearing 6 and the second suction-side bearing 11 in a first lubrication path 70B is reversed and, in association with it, disposing of a shaft seal member 15B is changed to the side of the first suction-side shaft hole 52*a*. That is, the first lubrication path 70B is configured in such a manner that the liquid fed from the external of the screw compressor 1B (external liquid feed system 100) lubricates the first suction-side bearing 6 and the second suction-side bearing 11 in that order and is collected into the bore 45.

Specifically, a second liquid feed passage 71B is opened to the outer circumferential surface of the main casing 41 and the primary chamber 50*a* of the first suction-side bearing chamber 50 and allows the primary chamber 50*a* of the first suction-side bearing chamber 50 to communicate with the external of the main casing 41. A first collection liquid passage 72B is opened to the region in the suction process in the bore 45 and the primary chamber 51*a* of the second suction-side bearing chamber 51 and allows the primary chamber 51*a* of the second suction-side bearing chamber 51 to communicate with the region in the suction process in the bore 45. The flow passage sectional area of the second liquid feed passage 71B and the first collection liquid passage 72B is set corresponding to the higher flow rate of either one of the necessary feed flow rate of the first suction-side bearing 6 and the necessary feed flow rate of the second suction-side bearing 11.

On the basis of the above-described configuration, in the first lubrication path 70B of the present embodiment, the second liquid feed passage 71B, a passage in which the liquid circulates from the primary chamber 50*a* to the secondary chamber 50*b* of the first suction-side bearing chamber 50 and the seal chamber 43*b* of the suction-side cover 43 and lubricates the first suction-side bearing 6 (passage that passes from the end surface of the first suction-side bearing 6 on the side of the bore 45 through the end surface on the other side), the communication passage 73, a passage in which the liquid circulates from the secondary chamber 51*b* to the primary chamber 51*a* of the second suction-side bearing chamber 51 and lubricates the second suction-side bearing 11 (passage that passes from the end surface of the second suction-side bearing 11 on the opposite side to the side of the bore 45 through the end surface on the side of the bore 45), and the first collection liquid passage 72B are connected in series in that order. Also in the first lubrication path 70B, the liquid needs to be fed at the higher flow rate of either one of the necessary feed flow rate of the first suction-side bearing 6 and the necessary feed flow rate of the second suction-side bearing 11, and the liquid is collected into the bore 45 at the higher flow rate of either one of the necessary feed flow rates of the first and second suction-side bearings 6 and 11.

Furthermore, the shaft seal member 15B is disposed in the gap between the suction-side shaft section 22 of the male rotor 2 supported by the first suction-side bearing 6 located on the upstream side of the second suction-side bearing 11 in the first lubrication path 70B and the first suction-side shaft hole 52*a* in which the suction-side shaft section 22 is inserted. The shaft seal member 15B seals the gap between the first suction-side shaft hole 52*a* and the suction-side shaft section 22 of the male rotor 2.

In the present embodiment, part of the liquid from the external liquid feed system 100 (see FIG. 2) flows into the primary chamber 50*a* of the first suction-side bearing chamber 50 through the second liquid feed passage 71B of the main casing 41. The liquid in the primary chamber 50*a* of the first suction-side bearing chamber 50 lubricates the first suction-side bearing 6 while passing through it and flows out to the secondary chamber 50*b* of the first suction-side bearing chamber 50 and the seal chamber 43*b* of the suction-side cover 43. The liquid in the secondary chamber 50*b* of the first suction-side bearing chamber 50 and the seal chamber 43*b* of the suction-side cover 43 lubricates the seal member 9 and flows into the secondary chamber 51*b* of the second suction-side bearing chamber 51 through the communication passage 73. The liquid in the secondary chamber 51*b* of the second suction-side bearing chamber 51 lubricates the second suction-side bearing 11 while passing through it and flows out to the primary chamber 51*a* of the second suction-side bearing chamber 51. The liquid in the primary chamber 51*a* of the second suction-side bearing chamber 51 is collected into the region of the suction process of the working chambers C in the bore 45 through the first collection liquid passage 72B.

As above, in the first lubrication path 70B of the present embodiment, the liquid fed from the external lubricates the first suction-side bearing 6 and thereafter lubricates the second suction-side bearing 11 and is finally collected in the bore 45. That is, the first lubrication path 70B is the path obtained by connecting in series, sequentially from the upstream side, the second liquid feed passage 71B, the passage to lubricate the first suction-side bearing 6 from the primary chamber 50*a* of the first suction-side bearing chamber 50 to the secondary chamber 50*b* of the first suction-side bearing chamber 50 and the seal chamber 43*b* of the suction-side cover 43, the communication passage 73, the passage to lubricate the second suction-side bearing 11 from the secondary chamber 51*b* to the primary chamber 51*a* of the second suction-side bearing chamber 51, and the first collection liquid passage 72B. In the first lubrication path 70B in which the respective passages to lubricate the first suction-side bearing 6 and the second suction-side bearing 11 are connected in series, similarly to the first lubrication path 70 of the first embodiment and the modification example thereof, seizure and damage due to insufficiency of the lubrication of the first suction-side bearing 6 and the second suction-side bearing 11 can be prevented by setting the higher flow rate in the necessary liquid feed flow rate of the first suction-side bearing 6 and the necessary liquid feed flow rate of the second suction-side bearing 11 as the liquid feed flow rate of the first lubrication path 70B. As a result, the flow rate of the liquid collected into the bore 45 also becomes the higher flow rate in the respective necessary liquid feed flow rates of the first and second suction-side bearings 6 and 11.

Furthermore, in the present embodiment, the shaft seal member 15B is disposed in the gap between the suction-side shaft section 22 of the male rotor 2 supported by the first suction-side bearing 6 located on the upstream side of the first lubrication path 70B and the first suction-side shaft hole 52*a* in which the suction-side shaft section 22 is inserted. Thus, it is possible to prevent the liquid that lubricates the first suction-side bearing 6 from leaking into the bore 45 through the gap between the first suction-side shaft hole 52*a* and the suction-side shaft section 22 of the male rotor 2. This can further reduce the flow rate of the liquid fed to the first lubrication path 70B and the flow rate of the liquid collected in the bore 45 through the first lubrication path 70B similarly to the modification example of the first embodiment. Therefore, the power to stir the liquid by both the male and female rotors 2 and 3 is further suppressed. In addition, the amount of scattering of the liquid to the vicinity of the suction flow passage 47 is further suppressed and the amount of heating and pressure loss regarding the sucked gas are reduced. As a result, energy saving of the screw compressor 1B can be implemented.

As described above, according to the second embodiment, similarly to the first embodiment and the modification example thereof, the respective passages to lubricate each of the first suction-side bearing 6 and the second suction-side bearing 11 are connected in series. Thus, it suffices that the liquid is fed to the first lubrication path 70B at the highest flow rate in the necessary liquid feed flow rates of the first suction-side bearing 6 and the second suction-side bearing 11. Therefore, compared with the conventional configuration in which the respective paths to lubricate the first suction-side bearing 6 and the second suction-side bearing 11 are in parallel, the flow rate of the liquid for the first suction-side bearing 6 and the second suction-side bearing 11 collected into the bore (housing chamber) 45 can be reduced.

Third Embodiment

Figure 6:
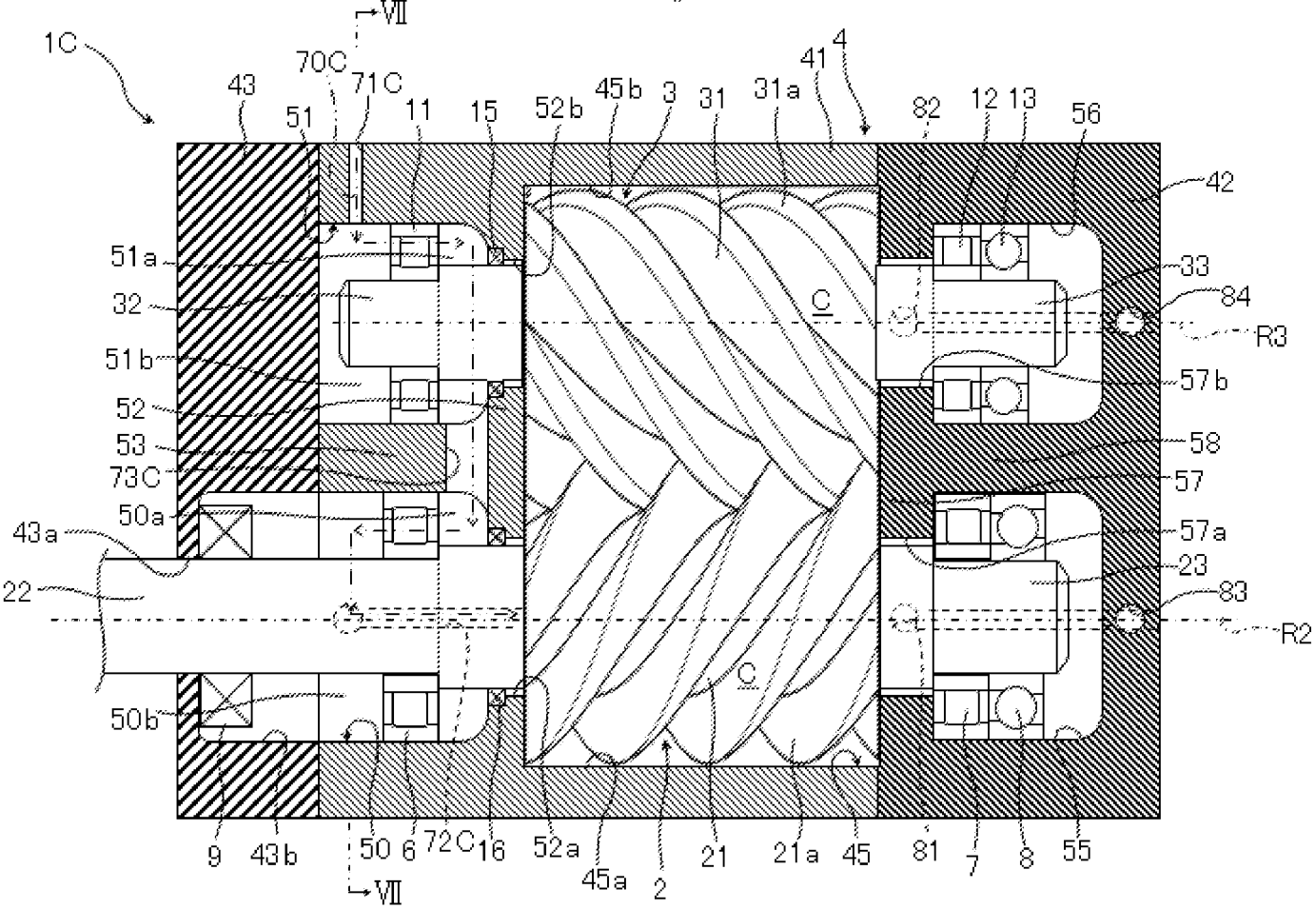
FIG. 6 is a horizontal sectional view illustrating a screw compressor according to a third embodiment of the present invention.
Figure 7:
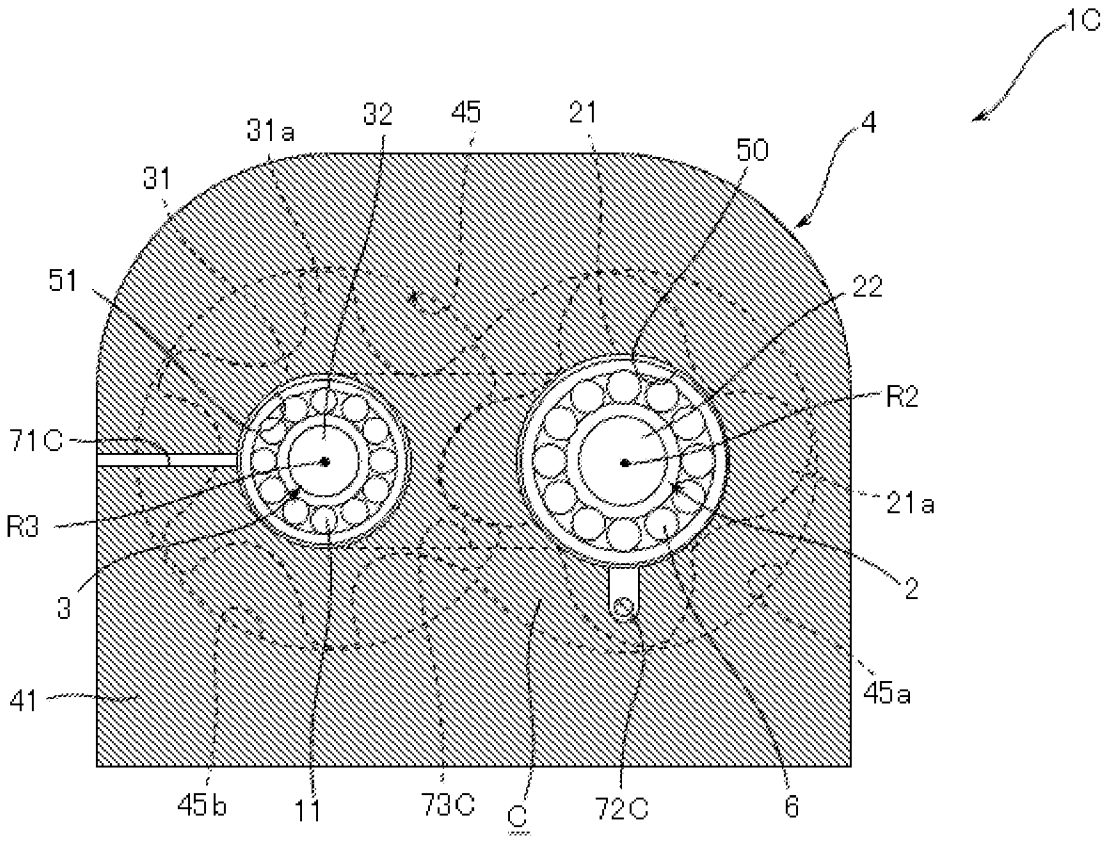
FIG. 7 is a sectional view when the screw compressor according to the third embodiment of the present invention illustrated in FIG. 6 is viewed in a direction of arrows VII-VII.

Next, a screw compressor according to a third embodiment of the present invention will be exemplified and described by using FIG. 6 and FIG. 7. FIG. 6 is a horizontal sectional view illustrating the screw compressor according to the third embodiment of the present invention. FIG. 7 is a sectional view when the screw compressor according to the third embodiment of the present invention illustrated in FIG. 6 is viewed in a direction of arrows VII-VII. In FIG. 6, the left side is the suction side of the screw compressor and the right side is the discharge side. In FIG. 6 and FIG. 7, a part having the same numeral as the numeral illustrated in FIG. 1 to FIG. 5 is a similar part and therefore detailed description thereof is omitted.

The different points of a screw compressor 1C according to the third embodiment illustrated in FIG. 6 and FIG. 7 from the screw compressor 1A (see FIG. 4) according to the modification example of the first embodiment are that the path is changed while the order of lubrication of the first suction-side bearing 6 and the second suction-side bearing 11 in a first lubrication path 70C is kept, and that the screw compressor 1C further includes a shaft seal member 16 corresponding to the first suction-side bearing chamber 50 located on the downstream side of the first lubrication path 70C in addition to the shaft seal member 15 corresponding to the second suction-side bearing chamber 51 located on the upstream side of the first lubrication path 70C.

Specifically, a second liquid feed passage 71C is opened to the outer circumferential surface of the main casing 41 and the secondary chamber 51*b* of the second suction-side bearing chamber 51 and allows the secondary chamber 51*b* of the second suction-side bearing chamber 51 to communicate with the external of the main casing 41. A first collection liquid passage 72C is opened to the region in the suction process in the bore 45 and the secondary chamber 50*b* of the first suction-side bearing chamber 50 and allows the secondary chamber 50*b* of the first suction-side bearing chamber 50 to communicate with the region in the suction process in the bore 45. There is provided in the bearing chamber partition 53 a communication passage 73C that allows the primary chamber 51*a* of the second suction-side bearing chamber 51 to communicate with the primary chamber 50*a* of the first suction-side bearing chamber 50. That is, the primary chamber 51*a* of the second suction-side bearing chamber 51 and the primary chamber 50*a* of the first suction-side bearing chamber 50 are connected through the communication passage 73C. The flow passage sectional area of the second liquid feed passage 71C and the first collection liquid passage 72C is set corresponding to the higher flow rate of either one of the necessary feed flow rate of the first suction-side bearing 6 and the necessary feed flow rate of the second suction-side bearing 11.

On the basis of the above-described configuration, in the first lubrication path 70C of the present embodiment, the second liquid feed passage 71C, a passage in which the liquid circulates from the secondary chamber 51*b* to the primary chamber 51*a* of the second suction-side bearing chamber 51 and lubricates the second suction-side bearing 11 (passage that passes from the end surface of the second suction-side bearing 11 on the opposite side to the side of the bore 45 through the end surface on the side of the bore 45), the communication passage 73C, a passage in which the liquid circulates from the primary chamber 50*a* of the first suction-side bearing chamber 50 to the secondary chamber 50*b* and the seal chamber 43*b* of the suction-side cover 43 and lubricates the first suction-side bearing 6 (passage that passes from the end surface of the first suction-side bearing 6 on the side of the bore 45 through the end surface on the other side), and the first collection liquid passage 72C are connected in series in that order. Also in the first lubrication path 70C, the liquid needs to be fed at the higher flow rate of either one of the necessary feed flow rate of the first suction-side bearing 6 and the necessary feed flow rate of the second suction-side bearing 11, and the liquid is collected into the bore 45 at the higher flow rate of either one of the necessary feed flow rates of the first and second suction-side bearings 6 and 11.

Furthermore, the shaft seal member 16 is disposed in the gap between the suction-side shaft section 22 of the male rotor 2 supported by the first suction-side bearing 6 located on the downstream side of the second suction-side bearing 11 in the first lubrication path 70C and the first suction-side shaft hole 52*a* in which the suction-side shaft section 22 is inserted. The shaft seal member 16 seals the gap between the first suction-side shaft hole 52*a* and the suction-side shaft section 22 of the male rotor 2.

In the present embodiment, part of the liquid from the external liquid feed system 100 (see FIG. 2) flows into the secondary chamber 51*b* of the second suction-side bearing chamber 51 through the second liquid feed passage 71C of the main casing 41. The liquid in the secondary chamber 51*b* of the second suction-side bearing chamber 51 lubricates the second suction-side bearing 11 while passing through it and flows out to the primary chamber 51*a* of the second suction-side bearing chamber 51. The liquid in the primary chamber 51*a* of the second suction-side bearing chamber 51 flows into the primary chamber 50*a* of the first suction-side bearing chamber 50 through the communication passage 73C. The liquid in the primary chamber 50*a* of the first suction-side bearing chamber 50 lubricates the first suction-side bearing 6 while passing through it and flows out to the secondary chamber 50*b* of the first suction-side bearing chamber 50 and the seal chamber 43*b* of the suction-side cover 43. The liquid in the secondary chamber 50*b* of the first suction-side bearing chamber 50 and the seal chamber 43*b* of the suction-side cover 43 lubricates the seal member 9 and is collected into the region of the suction process of the working chambers C in the bore 45 through the first collection liquid passage 72C.

As above, in the first lubrication path 70C of the present embodiment, the liquid fed from the external lubricates the second suction-side bearing 11 and thereafter lubricates the first suction-side bearing 6 and is finally collected into the bore 45. That is, the first lubrication path 70C of the present embodiment is the path obtained by connecting in series, sequentially from the upstream side, the second liquid feed passage 71C, the passage to lubricate the second suction-side bearing 11 from the secondary chamber 51*b* to the primary chamber 51*a* of the second suction-side bearing chamber 51, the communication passage 73C, the passage to lubricate the first suction-side bearing 6 from the primary chamber 50*a* to the secondary chamber 50*b* of the first suction-side bearing chamber 50 and the seal chamber 43*b* of the suction-side cover 43, and the first collection liquid passage 72C. In the first lubrication path 70C in which the respective passages to lubricate the first suction-side bearing 6 and the second suction-side bearing 11 are connected in series, similarly to the first lubrication path 70 of the first embodiment and the modification example thereof, seizure and damage due to insufficiency of the lubrication of the first suction-side bearing 6 and the second suction-side bearing 11 can be prevented by setting the higher flow rate in the necessary liquid feed flow rate of the first suction-side bearing 6 and the necessary liquid feed flow rate of the second suction-side bearing 11 as the liquid feed flow rate of the first lubrication path 70C. As a result, the flow rate of the liquid to be collected into the bore 45 also becomes the higher flow rate in the respective necessary liquid feed flow rates of the first and second suction-side bearings 6 and 11.

Furthermore, in the first lubrication path 70C of the present embodiment, differently from the first lubrication path 70 of the modification example of the first embodiment, the liquid in the primary chamber 50*a* of the suction-side bearing chamber 50 is going to lubricate the first suction-side bearing 6 located on the downstream side of the first lubrication path 70. Therefore, it is preferable to prevent leakage of the liquid into the bore 45 from the primary chamber 50*a* of the suction-side bearing chamber 50 through the first suction-side shaft hole 52*a*. In the present embodiment, in the gaps between the suction-side shaft sections 22 and 32 of both the male and female rotors 2 and 3 and the first and second suction-side shaft holes 52*a* and 52*b* in which the suction-side shaft sections 22 and 32 are inserted, the shaft seal members 15 and 16, respectively, are disposed. Thus, it is possible to prevent the liquid that lubricates the first suction-side bearing 6 and the second suction-side bearing 11 from leaking into the bore 45 through the first suction-side shaft hole 52*a* and the second suction-side shaft hole 52*b*. Therefore, it is possible to further reduce, by the shaft seal members 15 and 16, the flow rate of the liquid to be fed to the first lubrication path 70C and the flow rate of the liquid to be collected into the bore 45 through the first lubrication path 70C.

As described above, according to the third embodiment, similarly to the first embodiment and the modification example thereof, the respective passages to lubricate each of the first suction-side bearing 6 and the second suction-side bearing 11 are connected in series. Thus, it suffices that the liquid is fed to the first lubrication path 70C at the highest flow rate in the necessary liquid feed flow rates of the first suction-side bearing 6 and the second suction-side bearing 11. Therefore, compared with the conventional configuration in which the respective paths to lubricate the first suction-side bearing 6 and the second suction-side bearing 11 are in parallel, the flow rate of the liquid for the first suction-side bearing 6 and the second suction-side bearing 11 collected into the bore (housing chamber) 45 can be reduced.

Fourth Embodiment

Figure 8:
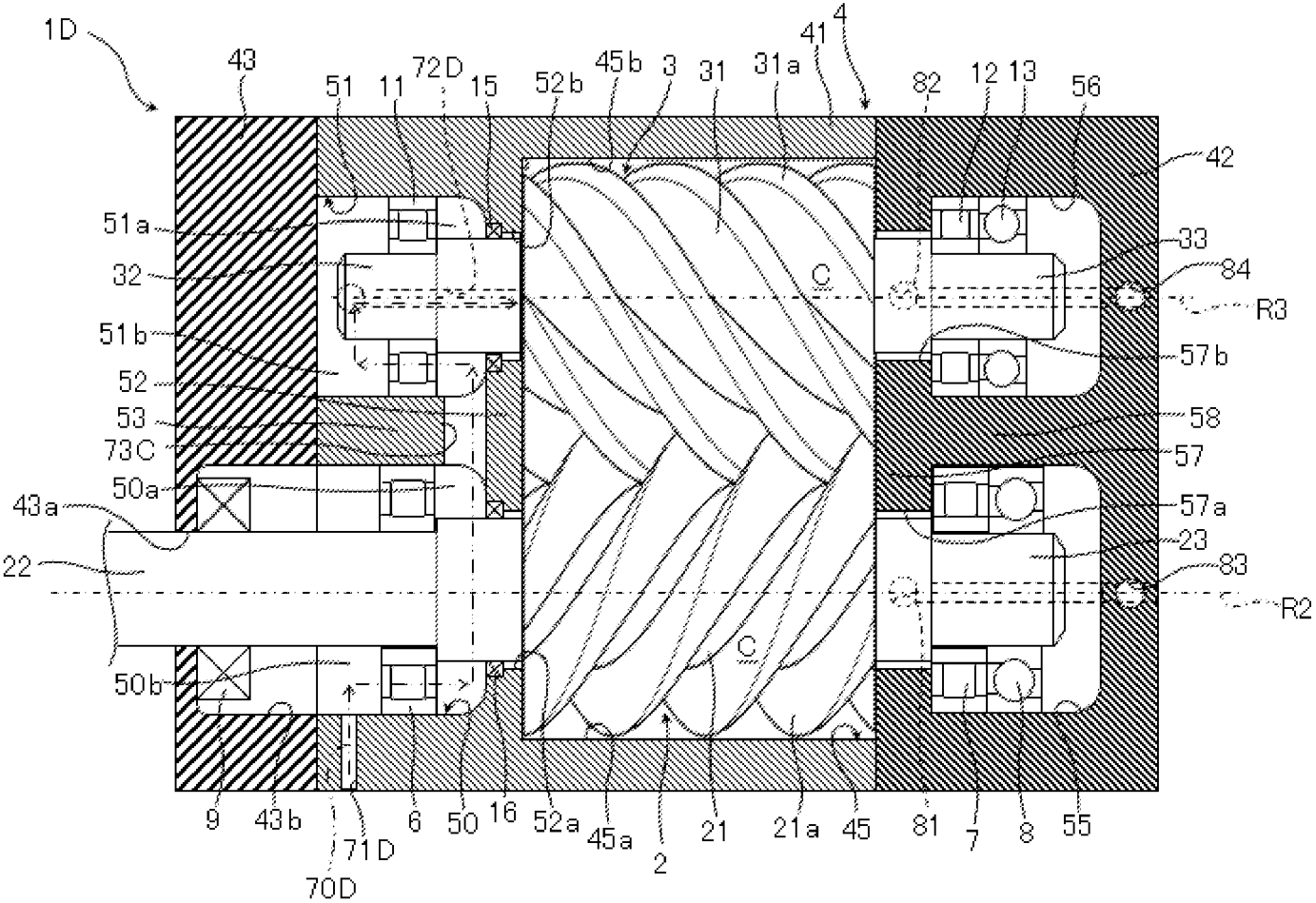
FIG. 8 is a horizontal sectional view illustrating a screw compressor according to a fourth embodiment of the present invention.

Next, a screw compressor according to a fourth embodiment of the present invention will be exemplified and described by using FIG. 8. FIG. 8 is a horizontal sectional view illustrating the screw compressor according to the fourth embodiment of the present invention. In FIG. 8, the left side is the suction side of the screw compressor and the right side is the discharge side. In FIG. 8, a part having the same numeral as the numeral illustrated in FIG. 1 to FIG. 7 is a similar part and therefore detailed description thereof is omitted.

The different point of a screw compressor 1D according to the fourth embodiment illustrated in FIG. 8 from the screw compressor 1C (see FIG. 6 and FIG. 7) according to the third embodiment is that the order of lubrication of the first suction-side bearing 6 and the second suction-side bearing 11 in a first lubrication path 70D is reversed. That is, the first lubrication path 70D is configured in such a manner that the liquid fed from the external of the screw compressor 1D (external liquid feed system 100) lubricates the first suction-side bearing 6 and the second suction-side bearing 11 in that order and is collected into the bore 45.

Specifically, a second liquid feed passage 71D is opened to the outer circumferential surface of the main casing 41 and the secondary chamber 50*b* of the first suction-side bearing chamber 50 and allows the secondary chamber 50*b* of the first suction-side bearing chamber 50 to communicate with the external of the main casing 41. A first collection liquid passage 72D is opened to the region in the suction process in the bore 45 and the secondary chamber 51*b* of the second suction-side bearing chamber 51 and allows the secondary chamber 51*b* of the second suction-side bearing chamber 51 to communicate with the region in the suction process in the bore 45. The flow passage sectional area of the second liquid feed passage 71D and the first collection liquid passage 72D is set corresponding to the higher flow rate of either one of the necessary feed flow rate of the first suction-side bearing 6 and the necessary feed flow rate of the second suction-side bearing 11.

On the basis of the above-described configuration, in the first lubrication path 70D of the present embodiment, the second liquid feed passage 71D, a passage in which the liquid circulates from the seal chamber 43*b* of the suction-side cover 43 and the secondary chamber 50*b* to the primary chamber 50*a* of the first suction-side bearing chamber 50 and lubricates the first suction-side bearing 6 (passage that passes from the end surface of the first suction-side bearing 6 on the opposite side to the side of the bore 45 through the end surface on the side of the bore 45), the communication passage 73C, a passage in which the liquid circulates from the primary chamber 51*a* to the secondary chamber 51*b* of the second suction-side bearing chamber 51 and lubricates the second suction-side bearing 11 (passage that passes from the end surface of the second suction-side bearing 11 on the side of the bore 45 through the end surface on the other side), and the first collection liquid passage 72D are connected in series in that order. Also in the first lubrication path 70D, the liquid needs to be fed at the higher flow rate of either one of the necessary feed flow rate of the first suction-side bearing 6 and the necessary feed flow rate of the second suction-side bearing 11, and the liquid is collected into the bore 45 at the higher flow rate of either one of the necessary feed flow rates of the first and second suction-side bearings 6 and 11.

In the present embodiment, part of the liquid from the external liquid feed system 100 (see FIG. 2) flows into the secondary chamber 50*b* of the first suction-side bearing chamber 50 and the seal chamber 43*b* of the suction-side cover 43 through the second liquid feed passage 71D of the main casing 41 and lubricates the seal member 9. The liquid in the secondary chamber 51*b* of the first suction-side bearing chamber 50 and the seal chamber 43*b* of the suction-side cover 43 lubricates the first suction-side bearing 6 while passing through it and flows out to the primary chamber 50*a* of the first suction-side bearing chamber 50. The liquid in the primary chamber 50*a* of the first suction-side bearing chamber 50 flows into the primary chamber 51*a* of the second suction-side bearing chamber 51 through the communication passage 73C. The liquid in the primary chamber 50*a* of the second suction-side bearing chamber 51 lubricates the second suction-side bearing 11 while passing through it and flows out to the secondary chamber 51*b* of the second suction-side bearing chamber 51. The liquid in the secondary chamber 51*b* of the second suction-side bearing chamber 51 is collected into the region of the suction process of the working chambers C in the bore 45 through the first collection liquid passage 72D.

As above, in the first lubrication path 70D of the present embodiment, the liquid fed from the external lubricates the first suction-side bearing 6 and thereafter lubricates the second suction-side bearing 11 and is finally collected into the bore 45. That is, the first lubrication path 70D of the present embodiment is the path obtained by connecting in series, sequentially from the upstream side, the second liquid feed passage 71D, the passage to lubricate the first suction-side bearing 6 from the seal chamber 43*b* of the suction-side cover 43 and the secondary chamber 50*b* to the primary chamber 50*a* of the first suction-side bearing chamber 50, the communication passage 73C, the passage to lubricate the second suction-side bearing 11 from the primary chamber 51*a* to the secondary chamber 51*b* of the second suction-side bearing chamber 51, and the first collection liquid passage 72D. In the first lubrication path 70D in which the respective passages to lubricate the first suction-side bearing 6 and the second suction-side bearing 11 are connected in series, similarly to the first lubrication path 70C of the third embodiment, seizure and damage due to insufficiency of the lubrication of the first suction-side bearing 6 and the second suction-side bearing 11 can be prevented by setting the higher flow rate in the necessary liquid feed flow rate of the first suction-side bearing 6 and the necessary liquid feed flow rate of the second suction-side bearing 11 as the liquid feed flow rate of the first lubrication path 70D. As a result, the flow rate of the liquid to be collected into the bore 45 also becomes the higher flow rate in the respective necessary liquid feed flow rates of the first and second suction-side bearings 6 and 11.

As described above, according to the fourth embodiment, similarly to the third embodiment, the respective passages to lubricate each of the first suction-side bearing 6 and the second suction-side bearing 11 are connected in series. Thus, it suffices that the liquid is fed to the first lubrication path 70D at the highest flow rate in the necessary liquid feed flow rates of the first suction-side bearing 6 and the second suction-side bearing 11. Therefore, compared with the conventional configuration in which the respective paths to lubricate the first suction-side bearing 6 and the second suction-side bearing 11 are in parallel, the flow rate of the liquid for the first suction-side bearing 6 and the second suction-side bearing 11 collected into the bore (housing chamber) 45 can be reduced.

Other Embodiments

The present invention is not limited to the above-described embodiments and various modification examples are included. The above-described embodiments are what are described in detail for explaining the present invention in an easy-to-understand manner and are not necessarily limited to what includes all configurations described. That is, it is possible to replace part of a configuration of a certain embodiment by a configuration of another embodiment. Furthermore, it is also possible to add a configuration of another embodiment to a configuration of a certain embodiment. In addition, it is also possible to implement addition, deletion, and substitution of another configuration regarding part of a configuration of each embodiment.

For example, in the above-described embodiments, examples are shown in which the outer diameter of the suction-side shaft section 32 and the discharge-side shaft section 33 of the female rotor 3 is set to be smaller than the outer diameter of the suction-side shaft section 22 and the discharge-side shaft section 23 of the male rotor 2. In contrast, a configuration is also possible in which the suction-side shaft section 32 and the discharge-side shaft section 33 of the female rotor 3 have the same outer diameter as the outer diameter of the suction-side shaft section 22 and the discharge-side shaft section 23 of the male rotor 2.

Furthermore, in the above-described embodiments, the example of the external liquid feed system 100 is shown that branches into the liquid feed path to the working chambers C and the liquid feed path to the bearings 6, 7, 8, 11, 12, and 13 outside the casing 4. However, it is also possible to make a configuration in which the liquid feed path to the working chambers C and the liquid feed path to the bearings 6, 7, 8, 11, 12, and 13 in the external liquid feed system 100 are configured by common one path and a branch into the liquid feed path to the working chambers C and the liquid feed path to the bearings 6, 7, 8, 11, 12, and 13 is made inside the casing 4.

Moreover, in the above-described embodiments, examples of the configuration in which the male rotor 2 and the female rotor 3 are disposed in such a manner that the axis lines R2 and R3 of both of the male rotor 2 and the female rotor 3 are horizontal, a so-called transversely-disposed configuration, are shown. However, a configuration in which the male rotor 2 and the female rotor 3 are disposed in such a manner that the axis lines R2 and R3 of both of the male rotor 2 and the female rotor 3 are substantially parallel to the vertical direction, a so-called longitudinally-disposed configuration, is also possible.

Furthermore, in the above-described embodiments, explanation has been made by taking as examples the screw compressors 1, 1A, 1B, 1C, and 1D of the twin-rotor type. However, the present invention can be applied also to a screw compressor including three or more screw rotors, such as a triple-rotor type. Also in this case, due to series connection of the respective passages to lubricate each of plural suction-side bearings that each support the suction side of plural screw rotors, there is no need to feed a liquid to a first lubrication path in which the liquid that lubricates the plural suction-side bearings circulates at the flow rate obtained by summing up the necessary feed flow rates of the respective suction-side bearings, and it suffices that the liquid is fed at the highest flow rate in the necessary feed flow rates of the respective suction-side bearings. Therefore, compared with the conventional configuration in which the respective paths to lubricate the plural suction-side bearings are in parallel, the flow rate of the liquid for the suction-side bearings collected into the housing chamber of the casing can be reduced.

Figure 9:
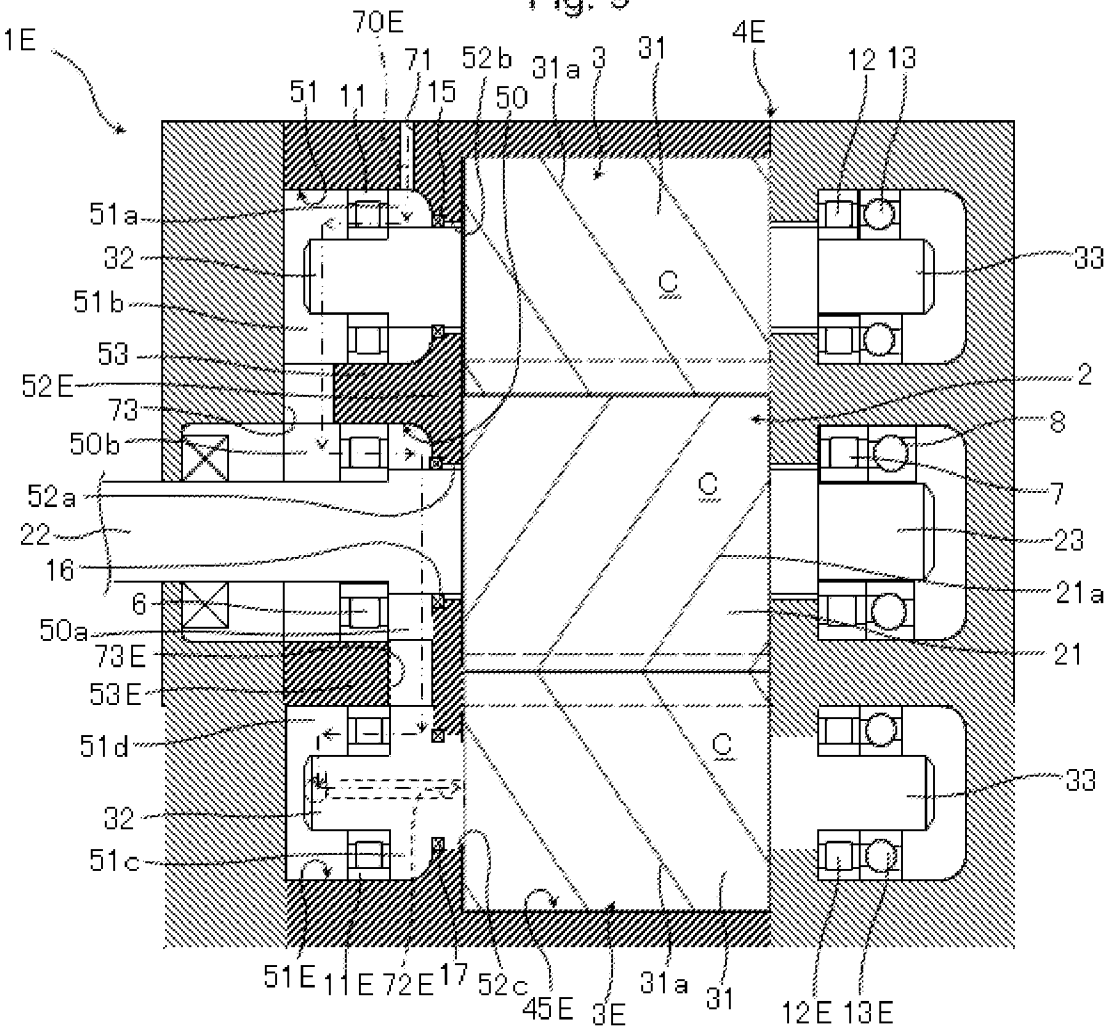
FIG. 9 is a horizontal sectional view illustrating a screw compressor according to another embodiment of the present invention.

The case in which the present invention is applied to a screw compressor of a triple-rotor type will be simply described by using FIG. 9. FIG. 9 is a horizontal sectional view illustrating a screw compressor according to another embodiment of the present invention. In FIG. 9, the left side is the suction side of the screw compressor and the right side is the discharge side. In FIG. 9, a part having the same numeral as the numeral illustrated in FIG. 1 to FIG. 8 is a similar part and therefore detailed description thereof is omitted.

A screw compressor 1E according to the other embodiment includes three screw rotors, which are composed of the male rotor 2 and two female rotors 3 and 3E that mesh with it, and a casing 4E that rotatably houses the three screw rotors 2, 3, and 3E, for example. In the present embodiment, a structure corresponding to further inclusion of the female rotor 3E is added compared with the screw compressor 1 of the twin-rotor type according to the first embodiment.

The suction side and the discharge side of the female rotor 3E are rotatably supported by a third suction-side bearing 11E and third discharge-side bearings 12E and 13E, respectively. The third suction-side bearing 11E and the third discharge-side bearings 12E and 13E are housed in the casing 4E. Inside the casing 4E, a bore 45E is formed as a housing chamber in which the lobe section 21 of the male rotor 2, the lobe section 31 of the female rotor 3, and the lobe section 31 of the female rotor 3E are housed. There is provided in the casing 4E, in addition to the first suction-side bearing chamber 50 and the second suction-side bearing chamber 51, a third suction-side bearing chamber 51E in which the third suction-side bearing 11E is disposed. The first suction-side bearing chamber 50 and the third suction-side bearing chamber 51E are marked out by a bearing chamber partition 53E. The third suction-side bearing chamber 51E is divided into a primary chamber 51*c* close to the bore 45E and a secondary chamber 51*d* remoter from the bore 45E than the primary chamber 51*c* across the third suction-side bearing 11E. The first to third suction-side bearing chambers 50, 51, and 51E are separated from the bore 45E by a suction-side partition 52E. There is provided in the suction-side partition 52E, in addition to the first suction-side shaft hole 52*a* and the second suction-side shaft hole 52*b*, a third suction-side shaft hole 52*c* in which the suction-side shaft section 32 of the female rotor 3E is inserted.

The screw compressor 1E includes, inside the casing 4E, a first lubrication path 70E in which the liquid that lubricates the first suction-side bearing 6, the second suction-side bearing 11, and the third suction-side bearing 11E circulates. In the first lubrication path 70E, a passage to lubricate the first suction-side bearing 6, a passage to lubricate the second suction-side bearing 11, and a passage to lubricate the third suction-side bearing 11E are connected in series and the most downstream part is connected to the bore 45E. That is, the first lubrication path 70E is configured in such a manner that the liquid fed from the external of the screw compressor 1 (external liquid feed system 100) lubricates the second suction-side bearing 11, the first suction-side bearing 6, and the third suction-side bearing 11E in that order and is collected into the bore 45E.

Specifically, there is provided in the casing 4E, in addition to the second liquid feed passage 71, a first collection liquid passage 72E that is opened to the region in the suction process in the bore 45E and the secondary chamber 51*d* of the third suction-side bearing chamber 51E and that allows the secondary chamber 51*d* of the third suction-side bearing chamber 51E to communicate with the region in the suction process in the bore 45E. The primary chamber 50*a* of the first suction-side bearing chamber 50 and the primary chamber 51*c* of the third suction-side bearing chamber 51E are connected through a communication passage 73E.

On the basis of the above-described configuration, in the first lubrication path 70E of the present embodiment, the second liquid feed passage 71, a passage in which the liquid circulates from the primary chamber 51*a* to the secondary chamber 51*b* of the second suction-side bearing chamber 51 and lubricates the second suction-side bearing 11 (passage that passes from the end surface of the second suction-side bearing 11 on the side of the bore 45E through the end surface on the other side), the communication passage 73, a passage in which the liquid circulates from the seal chamber 43*b* of the suction-side cover 43 and the secondary chamber 50*b* to the primary chamber 50*a* of the first suction-side bearing chamber 50 and lubricates the first suction-side bearing 6 (passage that passes from the end surface of the first suction-side bearing 6 on the opposite side to the side of the bore 45E through the end surface on the side of the bore 45E), the communication passage 73E, a passage in which the liquid circulates from the primary chamber 51*c* to the secondary chamber 51*d* of the third suction-side bearing chamber 51E and lubricates the third suction-side bearing 11E (passage that passes from the end surface of the third suction-side bearing 11E on the side of the bore 45E through the end surface on the other side), and the first collection liquid passage 72E are connected in series in that order. In the first lubrication path 70E, the liquid needs to be fed at the highest flow rate in the necessary feed flow rates of the first suction-side bearing 6, the second suction-side bearing 11, and the third suction-side bearing 11E, and the liquid is collected into the bore 45E at the highest flow rate in the necessary feed flow rates of the first to third suction-side bearings 6, 11, and 11E.

As above, according to the present embodiment, the respective passages to lubricate each of the three suction-side bearings 6, 11, and 11E are connected in series. Thus, the liquid does not need to be fed to the first lubrication path 70E at the flow rate obtained by summing up the necessary feed flow rates of the respective suction-side bearings 6, 11, and 11E, and it suffices that the liquid is fed at the highest flow rate in the necessary feed flow rates of the respective suction-side bearings 6, 11, and 11E. Therefore, compared with the conventional configuration in which the respective paths to lubricate the plural suction-side bearings are in parallel, the flow rate of the liquid for the suction-side bearings 6, 11, and 11E collected into the housing chamber 45E of the casing 4E can be reduced.

Furthermore, in the screw compressor 1 E, the shaft seal members 15, 16, and 17 are each disposed in the gaps between the suction-side shaft sections 22 and 32 of the three screw rotors 2, 3, and 3E and the three suction-side shaft holes 52*a*, 52*b*, and 52*c* corresponding to them. This can prevent the liquid that lubricates the first to third suction-side bearings 6, 11, and 11E from leaking into the bore 45E through the first to third suction-side shaft holes 52*a*, 52*b*, and 52*c*. Therefore, it is possible to further reduce, by the shaft seal members 15, 16, and 17, the flow rate of the liquid fed to the first lubrication path 70E and the flow rate of the liquid collected into the bore 45E through the first lubrication path 70E.

DESCRIPTION OF REFERENCE CHARACTERS

1, 1A, 1B, 1C, 1D, 1E: Screw compressor
2: Male rotor (the other or one of screw rotors)
3: Female rotor (one or the other of screw rotors)
3E: Female rotor (screw rotor),
4, 4E: Casing
6: First suction-side bearing (the other suction-side bearing, one suction-side bearing)
11: Second suction-side bearing (one suction-side bearing, the other suction-side bearing)
11E: Third suction-side bearing (suction-side bearing)
7, 8: First discharge-side bearing (discharge-side bearing)
12, 13: Second discharge-side bearing (discharge-side bearing)
12E, 13E: Third discharge-side bearing (discharge-side bearing)
15, 15B: Shaft seal member
16: Shaft seal member
17: Shaft seal member
21: Lobe section
21*a*: Male lobe (lobe)
22: Suction-side shaft section
23: Discharge-side shaft section
31: Lobe section
31*a*: Female lobe (lobe)
32: Suction-side shaft section
33: Discharge-side shaft section
45, 45E: Bore (housing chamber)
50: First suction-side bearing chamber (the other suction-side bearing chamber, one suction-side bearing chamber)
50*a*: Primary chamber
50*b*: Secondary chamber
51: Second suction-side bearing chamber (one suction-side bearing chamber, the other suction-side bearing chamber)
51*a*: Primary chamber
51*b*: Secondary chamber
51E: Third suction-side bearing chamber (suction-side bearing chamber)
52, 52E: Suction-side partition (partition)
52*a*: First suction-side shaft hole (the other shaft hole, one shaft hole)
52*b*: Second suction-side shaft hole (one shaft hole, the other shaft hole)
52*c*: Third suction-side shaft hole (shaft hole)
70, 70B, 70C, 70D, 70E: First lubrication path (lubrication path)
71, 71B, 71C, 71D: Second liquid feed passage (liquid feed passage)
72, 72B, 72C, 72D: First collection liquid passage (collection liquid passage)
73, 73C: Communication passage

The invention claimed is:

1. A screw compressor comprising:
a plurality of screw rotors;
a plurality of suction-side bearings that each rotatably support a suction side of the plurality of screw rotors and a plurality of discharge-side bearings that each rotatably support a discharge side of the plurality of screw rotors; and
a casing that houses the plurality of screw rotors, the plurality of suction-side bearings, and the plurality of discharge-side bearings, wherein
each of the plurality of screw rotors includes
a lobe section with a plurality of lobes, and
a suction-side shaft section and a discharge-side shaft section each disposed at both ends of the lobe section,
the casing has
a housing chamber that houses the lobe sections of the plurality of screw rotors, and
a lubrication path in which liquid that lubricates the plurality of suction-side bearings circulates, and the lubrication path is a path in which respective passages to lubricate each of the plurality of suction-side bearings are connected in series and a most downstream part is connected to the housing chamber, wherein the plurality of suction-side bearings include one suction-side bearing that supports one of the pair of screw rotors and an other suction-side bearing that supports other of the pair of screw rotors, a one suction-side bearing chamber and an other suction-side bearing chamber are divided into multiple chambers, the plurality of screw rotors are composed of a pair of screw rotors, the lubrication path is configured through series connection of a liquid feed passage into which the liquid fed from external flows, a first passage to lubricate the one suction-side bearing, a second passage to lubricate the other suction-side bearing, and a collection liquid passage that communicates with the housing chamber in that order, the other suction-side bearing chamber is divided into a primary chamber and a secondary chamber remoter from the housing chamber than the primary chamber across the other suction-side bearing, and the collection liquid passage is connected to the primary chamber of the other suction-side bearing chamber.

2. The screw compressor according to claim 1, wherein the casing has a plurality of suction-side bearing chambers in which the plurality of suction-side bearings are each disposed, and a plurality of shaft holes that are provided in a partition that separates the plurality of suction-side bearing chambers from the housing chamber and in which the suction-side shaft sections of the plurality of screw rotors are each inserted, and a shaft seal member is disposed in each of gaps between the suction-side shaft sections of the plurality of screw rotors and the plurality of shaft holes.

3. The screw compressor according to claim 1, wherein the casing has the one suction-side bearing chamber in which the one suction-side bearing is disposed and the other suction-side bearing chamber in which the other suction-side bearing is disposed, the one suction-side bearing chamber is divided into a primary chamber and a secondary chamber remoter from the housing chamber than the primary chamber across the one suction-side bearing, the liquid feed passage is connected to the primary chamber of the one suction-side bearing chamber, the first passage is a passage in which the liquid circulates from the primary chamber of the one suction-side bearing chamber to the secondary chamber of the one suction-side bearing chamber, the second passage is a passage in which the liquid circulates from the secondary chamber of the other suction-side bearing chamber to the primary chamber of the other suction-side bearing chamber, and the first passage and the second passage are connected through a communication passage that communicates with the secondary chamber of the one suction-side bearing chamber and the secondary chamber of the other suction-side bearing chamber.

4. The screw compressor according to claim 1, wherein the casing has one suction-side bearing chamber in which the one suction-side bearing is disposed and the other suction-side bearing chamber in which the other suction-side bearing is disposed, the other suction-side bearing chamber is divided into a primary chamber and a secondary chamber remoter from the housing chamber than the primary chamber across the other suction-side bearing, the liquid feed passage is connected to the secondary chamber of the one suction-side bearing chamber, the first passage is a passage in which the liquid circulates from the secondary chamber of the one suction-side bearing chamber to the primary chamber of the one suction-side bearing chamber, the second passage is a passage in which the liquid circulates from the primary chamber of the other suction-side bearing chamber to the secondary chamber of the other suction-side bearing chamber, and the first passage and the second passage are connected through a communication passage that communicates with the primary chamber of the one suction-side bearing chamber and the primary chamber of the other suction-side bearing chamber.

5. The screw compressor according to claim 1, wherein the casing has one suction-side bearing chamber in which the one suction-side bearing is disposed and the other suction-side bearing chamber in which the other suction-side bearing is disposed, and one shaft hole and other shaft hole that are provided in a partition that separates the one suction-side bearing chamber and the other suction-side bearing chamber from the housing chamber and in which the suction-side shaft sections of one and the other of the pair of screw rotors are each inserted, and a shaft seal member is disposed in a gap between the suction-side shaft section supported by the one suction-side bearing and the one shaft hole in which the suction-side shaft section is inserted.

6. The screw compressor according to claim 1, wherein the pair of screw rotors are disposed in such a manner that axis lines of both of the screw rotors are horizontal, and an outer diameter of the one suction-side bearing is smaller than an outer diameter of the other suction-side bearing.

7. The screw compressor according to claim 2, wherein the shaft seal members are supported by the other suction-side bearing located on the upstream side of the one suction-side bearing in the first passage and the second other suction-side shaft hole in which the suction-side shaft section is inserted, and the shaft seal members seal the gap between the other suction-side shaft hole and the suction-side shaft section of the rotor.

* * * * *